US008192591B2

(12) United States Patent
Zaikin et al.

(10) Patent No.: US 8,192,591 B2
(45) Date of Patent: Jun. 5, 2012

(54) SELF-SUSTAINING CRACKING OF HYDROCARBONS

(75) Inventors: Yuriy A. Zaikin, Raleigh, NC (US); Raissa F. Zaikina, Raleigh, NC (US)

(73) Assignee: Petrobeam, Inc., Raleigh, NC (US)

( * ) Notice: Subject to any disclaimer, the term of this patent is extended or adjusted under 35 U.S.C. 154(b) by 581 days.

(21) Appl. No.: 12/097,392

(22) PCT Filed: Dec. 15, 2006

(86) PCT No.: PCT/US2006/048066
§ 371 (c)(1),
(2), (4) Date: Sep. 2, 2009

(87) PCT Pub. No.: WO2007/070698
PCT Pub. Date: Jun. 21, 2007

(65) Prior Publication Data

US 2010/0051444 A1 Mar. 4, 2010

Related U.S. Application Data

(60) Provisional application No. 60/751,352, filed on Dec. 16, 2005.

(51) Int. Cl.
*C07B 63/02* (2006.01)

(52) U.S. Cl. ..... 204/158.21; 208/46; 208/402; 208/431; 252/312; 252/314; 252/330; 252/348

(58) Field of Classification Search ..... 208/46, 208/402, 431; 252/312, 314, 330, 348; 422/186.03, 422/186.16, 186.3; 204/158.21
See application file for complete search history.

(56) References Cited

U.S. PATENT DOCUMENTS 2,905,606 A 9/1959 Long et al.
2,905,607 A 9/1959 Long et al.
(Continued)

FOREIGN PATENT DOCUMENTS

CN 2214416 12/1995
(Continued)

OTHER PUBLICATIONS

"A Literature Review on Cold Cracking of Petroleum Crude Oil," *Energy Policy Act of 2005 Section 1406*, 2006, Prepared for Office of Oil and Natural Gas Office of Fossil Energy, U.S. Department of Energy by National Energy Technology Laboratory.

(Continued)

*Primary Examiner* — Prem C Singh
(74) *Attorney, Agent, or Firm* — Alston & Bird LLP

(57) ABSTRACT

The present disclosure provides a simple and efficient method for the self-sustaining radiation cracking of hydrocarbons. The method disclosed provides for the deep destructive processing of hydrocarbon chains utilizing hydrocarbon chain decomposition utilizing self-sustaining radiation cracking of hydrocarbon chains under a wide variety of irradiation conditions and temperature ranges (from room temperature to 400° C.). Several embodiments of such method are disclosed herein, including; (i) a special case of radiation-thermal cracking referred to as high-temperature radiation cracking (HTRC); (ii) low temperature radiation cracking (LTRC); and (iii) cold radiation cracking (CRC). Such methods were not heretofore appreciated in the art. In one embodiment, a petroleum feedstock is subjected to irradiation to initiate and/or at least partially propagate a chain reaction between components of the petroleum feedstock. In one embodiment, the treatment results in hydrocarbon chain decomposition; however, other chemical reactions as described herein may also occur.

19 Claims, 14 Drawing Sheets

U.S. PATENT DOCUMENTS

| | | | | |
|---|---|---|---|---|
| 2,905,608 | A | | 9/1959 | Noddings et al. |
| 2,951,022 | A | | 8/1960 | Hartzband et al. |
| 3,002,911 | A | | 10/1961 | Sutherland et al. |
| 3,153,622 | A | | 10/1964 | Humphrey et al. |
| 3,228,849 | A | | 1/1966 | Fellows |
| 3,228,850 | A | | 1/1966 | Fellows |
| 4,337,119 | A | | 6/1982 | Donahue |
| 4,426,278 | A | | 1/1984 | Kosters |
| 4,772,379 | A | * | 9/1988 | Gomberg ..... 208/402 |
| 4,968,403 | A | | 11/1990 | Herbst et al. |
| 5,015,349 | A | | 5/1991 | Suib et al. |
| 5,026,949 | A | | 6/1991 | Amouroux et al. |
| 5,073,349 | A | | 12/1991 | Herbst et al. |
| 5,110,443 | A | | 5/1992 | Gregoli et al. |
| 5,131,993 | A | | 7/1992 | Suib et al. |
| 5,181,998 | A | | 1/1993 | Murphy et al. |
| 5,238,897 | A | | 8/1993 | Cornwell |
| 5,250,482 | A | | 10/1993 | Doctor |
| 5,626,726 | A | | 5/1997 | Kong |
| 5,817,226 | A | | 10/1998 | Lenglet |
| 5,906,728 | A | | 5/1999 | Iaccino et al. |
| 6,033,901 | A | | 3/2000 | Powell, Jr. |
| 6,149,800 | A | | 11/2000 | Iaccino et al. |
| 6,153,086 | A | | 11/2000 | Gupta et al. |
| 6,190,537 | B1 | | 2/2001 | Kanataev et al. |
| 6,303,842 | B1 | | 10/2001 | Bridges et al. |
| 6,726,833 | B2 | | 4/2004 | Han et al. |
| 6,824,746 | B2 | | 11/2004 | Ayukawa et al. |
| 7,029,571 | B1 | | 4/2006 | Bhattacharyya et al. |
| 2001/0006146 | A1 | | 7/2001 | Campagna |
| 2002/0144928 | A1 | | 10/2002 | Bronshtein et al. |
| 2002/0166794 | A1 | | 11/2002 | Bronshtein et al. |
| 2002/0166797 | A1 | | 11/2002 | Banerjee |
| 2002/0169345 | A1 | | 11/2002 | Johnson |
| 2002/0189668 | A1 | | 12/2002 | Manson |
| 2003/0006167 | A1 | | 1/2003 | Han et al. |
| 2003/0017091 | A1 | | 1/2003 | Ayukawa et al. |
| 2003/0042174 | A1 | | 3/2003 | Austin |
| 2003/0047486 | A1 | | 3/2003 | Cash et al. |
| 2003/0051989 | A1 | | 3/2003 | Austin |
| 2003/0089637 | A1 | | 5/2003 | Gueret et al. |
| 2003/0089638 | A1 | | 5/2003 | Gueret et al. |
| 2003/0116471 | A1 | | 6/2003 | Zhang et al. |
| 2004/0004027 | A1 | | 1/2004 | Spicer et al. |
| 2004/0014593 | A1 | | 1/2004 | Le Van Mao |
| 2004/0186336 | A1 | | 9/2004 | Martin et al. |
| 2005/0025902 | A1 | | 2/2005 | Kerluke et al. |
| 2005/0031505 | A1 | | 2/2005 | Banerjee |
| 2005/0277544 | A1 | | 12/2005 | Mao |
| 2006/0016725 | A1 | | 1/2006 | Das et al. |
| 2006/0272981 | A1 | | 12/2006 | Gueret et al. |
| 2006/0287561 | A1 | | 12/2006 | Choi et al. |
| 2007/0284285 | A1 | | 12/2007 | Stepanik et al. |
| 2008/0202982 | A1 | | 8/2008 | Tooley |

FOREIGN PATENT DOCUMENTS

| | | | |
|---|---|---|---|
| CN | 1252486 | | 5/2000 |
| CN | 1362488 | | 8/2002 |
| CN | 1504442 | | 6/2004 |
| DE | 4225490 | A1 | 2/1994 |
| DE | 198 26 553 | | 12/1999 |
| EP | 0370910 | | 5/1990 |
| GB | 00659616 | | 10/1951 |
| GB | 00671635 | | 5/1952 |
| GB | 1018999 | | 2/1966 |
| GB | 1145902 | | 3/1969 |
| GB | 2073770 | | 10/1981 |
| JP | 62218485 | | 9/1987 |
| JP | 62218486 | | 9/1987 |
| JP | 62218487 | | 9/1987 |
| JP | 7238289 | | 9/1995 |
| JP | 7258657 | | 10/1995 |
| JP | 8061166 | | 3/1996 |
| JP | 2001192673 | | 7/2001 |
| JP | 2001212452 | | 8/2001 |
| KZ | B 11 4676 | | 6/1997 |
| KZ | 13 A 11 13036 | | 5/2003 |
| RU | 2063414 | | 7/1996 |
| RU | 2078116 | | 4/1997 |
| RU | 2087519 | | 8/1997 |
| RU | 2099387 | | 12/1997 |
| RU | 2100404 | | 12/1997 |
| RU | 2124040 | | 12/1998 |
| RU | 2142496 | | 12/1999 |
| RU | 2246525 | | 2/2005 |
| RU | 2252069 | | 5/2005 |
| WO | WO 93/19139 | | 9/1993 |
| WO | WO 94/04270 | | 3/1994 |
| WO | WO 94/27935 | | 12/1994 |
| WO | WO 95/07959 | | 3/1995 |
| WO | WO 96/10065 | | 4/1996 |
| WO | WO 98/04653 | | 2/1998 |
| WO | WO 98/07808 | | 2/1998 |
| WO | WO 98/12281 | | 3/1998 |
| WO | WO 99/19424 | | 4/1999 |
| WO | WO 99/61560 | | 12/1999 |
| WO | WO 01/32806 | | 5/2001 |
| WO | WO 01/60951 | | 8/2001 |
| WO | WO 02/00811 | | 1/2002 |
| WO | WO 02/60609 | | 8/2002 |
| WO | WO 02/102930 | | 12/2002 |
| WO | WO 02/103322 | | 12/2002 |
| WO | WO 03/074632 | | 9/2003 |
| WO | WO 2005/005580 | | 1/2005 |
| WO | WO 2005/047426 | | 5/2005 |
| WO | WO 2005/073346 | | 8/2005 |
| WO | WO 2006/134397 | | 12/2006 |

OTHER PUBLICATIONS

Aksenova et al., "Investigations on Radiation Processing in Kazakhstan," *Radiat. Phys. Chem.,* 1995, pp. 1401-1404, vol. 46, No. 4-6.

Cameron, "The Microwave Assisted Catalytic Decomposition of Olefins," *Thesis,* 1987, 112 pp., Queen's Univ., Kingston, ON Canada.

Dolivo et al., "Photoinduced Isomerization and Fragmentation of the Pentane Radical Cation in Condensed Phase," *Radiation Physics and Chemistry,* 1986, pp. 195-200, vol. 28, No. 2.

Genchanok et al., "Kinetics of High-Pressure Radiation-Thermal Hydrogenation of Heptene-1," *Petroleum Chemistry USSR,* 1989, pp. 19-24, vol. 29, No. 1.

Kabe, "Studies of Hydrocracking and Hydrodenitrogenation of Coal and Coal Liquid," *Research on Coal Liquefaction and Gasification,* 1984, pp. 41-50, Ministry of Education, Science and Culture, Tokyo, Japan.

Matsuoka et al., "Radiation-Initiated Thermal Cracking of n-Octane Vapor," *Bull. Jpn. Pet. Inst.,* 1975, pp. 58-64, vol. 17, No. 1.

Mirkin et al., "Radiation Methods for Upgrading and Refining of Feedstock for Oil Chemistry," *Radiation Physics and Chemistry,* 2003, pp. 311-314, vol. 67.

Odian et al. "Radiation-Induced Graft Polymerization: The Trommsdorff Effect of Methanol," *Journal of Polymer Science,* 1961, pp. 663-673, vol. 55, No. 162.

Page et al., "Thermal Conversion Processes", *Resid and Heavy Oil Processing,* 1992, Ch. 11.1, pp. 77-121.

Panchenkov et al., "Study of the Basic Principles of Radiation-Thermic Cracking of n-Hexadecane," *High Energy Chemistry,* 1981, pp. 331-334, vol. 15, No. 5.

Petukhov et al., "Use of Radiation Technologies for Oil Processing," *Ehkspress-Informatsiya. Novosti Nauki Kazakhstana,* 1994, pp. 23-25.

Pikaev, "New Developments in Radiation Processing in Russia: A Review," *High Energy Chemistry,* 1999, pp. 1-8, vol. 33, No. 1.

Schucker et al., "The Reactivity of Cold Lake Asphaltenes," *Prepr. Div. Fuel Chem., Amer. Chem. Soc.* 1980, pp. 155-165, vol. 25, No. 3.

Sukiasyan et al., "Oxidative Cracking of propane under the Action of Laser Radiation," *Kinetics and Catalysis,* 1989, pp. 236-239, vol. 30, No. 2.

Wu et al., "Radiation Effect on the Thermal Cracking of n-Hexadecane I. Products From Radiation-Thermal Cracking," *Ind. Eng. Chem. Res.,* 1997, pp. 1973-1978, vol. 36.

Zaykin et al., "On Energetics of Hydrocarbon Chemical Reactions by Ionizing Irradiation," *Radiation Physics and Chemistry,* 2003, pp. 305-309, vol. 67.
Zaykin et al., "Criteria of Synergetic Effects in Radiation-Induced Transformation of Complex Hydrocarbon Mixtures," *Oil & Gas,* 2004, pp. 64-73, vol. 2, No. 22, (Kazakstan).
Zaykin et al., "Bitumen Radiation Processing," *Radiation Physics and Chemistry,* 2004, pp. 469-472, vol. 71.
Zaykin et al., "Radiation-Initiated Cracking of Hyrdrocarbons and Its Application for Deep Conversion of Oil Feedstock," *Oil and Gas,* (Kazakhstan) 2004, pp. 47-57, vol. 4, No. 24.
Zaykin et al., "Radiation-Thermal Conversion of Paraffinic Oil," *Radiation and Physics and Chemistry,* 2004, pp. 229-238, vol. 69.
Zaykin et al., "Stimulation of Radiation-Thermal Caracking of Oil Products by Reactive Ozone-Containin Mixtures" *Radiat. Phys. Chem.,* 2004, pp. 475-478, vol. 71.
Zaykin et al., "New Technological Approaches to Cleaning, Upgrading and Desulfurization of Oil Wastes and Low-Grade Oil Products," *Oils and Environment, AUZO,* 2005, pp. 275-282.
Zaykin et al., "Effect of Pulse Electron Beam Characteristics on Internal Friction and Structural Alterations in Epoxy," *Radiation Physics and Chemistry,* 2007, pp. 1404-1408, vol. 76.
Zaykin et al., "New Trends in the Radiation Processing of Petroleum," *Radiation Physics Research Progress,* Chapter 1, pp. 17-103, 2008 Nova Publishers, Inc.
Zaykina et al., "Radiation-Thermal Processing of High-Viscous Oil From Karazhanbas Field," *Radiat. Phys. Chem.,* 2001, pp. 211-221, vol. 60.
Zaykina et al., "Prospects for Irradiation Processing in the Petroleum Industry," *Radiation Physics and Chemistry,* 2002, pp. 617-620, vol. 63.
Zaykina et al., "Radiation Methods for Demercaptanization and Desulfurization of Oil Products," *Radiation Physics and Chemistry,* 2003, pp. 621-624, vol. 63.
Zaykina et al., "Radiation Technologies for Production and Regeneration of Motor Fuel and Lubricants," 2002, pp. 169-172, vol. 65.
Zaykina et al., "Specific Approaches to Radiation Processing of High-Sulfuric Oil," 2004 *Radiation Physics and Chemistry,* pp. 465-468, vol. 71.
Zaykina et al., "Radiation-Based Processing of Hydrocarbons for Reduction of Environmental Pollution by Petroleum Products," *Oils and Environment, AUZO,* 2005, pp. 296-303.
Zhuravlev et al., "Radiothermal Effect on Heavy Crude Oil Residues," *High Energy Chemistry,* 1991, pp. 27-31, vol. 25, No. 1.
Zhussupov, "Assessing the Potential and Limitations of Heavy Oil Upgrading by Electron Beam Irradiation," 1996, *Thesis:* Submitted to the Office of Graduate Studies of Texas A&M University in Partial Fulfillment of the Requirements for the Degree of Master of Science.

* cited by examiner

SELF-SUSTAINING CRACKING OF HYDROCARBONS

CROSS-REFERENCE TO RELATED APPLICATIONS

The present application claims priority to and the benefit of U.S. Provisional Patent Application No. 60/751,352, filed Dec. 16, 2005.

FIELD OF THE DISCLOSURE

The present disclosure relates generally to the field of petroleum processing. More specifically, the present disclosure relates to novel method for self-sustained cracking of petroleum feedstocks to produce commodity petroleum products.

BACKGROUND

The petroleum refining industry has long been faced with the need to increase the efficiency of the production of commodity petroleum products from petroleum feedstock. In addition, the demand for particular commodity petroleum products has also increased. Furthermore, the quality of the commodity petroleum products produced has also been subject to increasing demands of stability and purity. For example, while many prior art processes have been described that produce commodity petroleum products with shorter hydrocarbon chain lengths from petroleum feedstocks containing higher hydrocarbon chain length precursors, the resulting commodity petroleum products are often unstable due to chemical species produced during the conversion process (such as but not limited to high olefinic content) or possess undesirable characteristics from a performance perspective (such as, but not limited to, low octane ratings) or an environmental perspective (such as, but not limited to, high sulfur content).

In addition, the petroleum industry is faced with the prospect of using multiple sources of petroleum feedstock that vary significantly in chemical content. In order to cope with the changing composition of the petroleum feedstock, methods must be developed that are flexible enough to be used with a variety of petroleum feedstocks without substantial alterations of the method. Such flexibility would expand the natural resources (i.e., petroleum feedstocks) available for the production of commodity petroleum products and further enhance the efficiency of production of commodity petroleum products.

In addition to being flexible enough to accommodate a variety of petroleum feedstocks as a starting material, production efficiency could be enhanced by a method flexible enough to produce a commodity petroleum product with a desired set of properties, such as but not limited to, a desired hydrocarbon chain length, from a given petroleum feedstock. For example, economic conditions or supply and demand in the marketplace may dictate that a lubricant with a higher hydrocarbon chain length than gasoline is a preferred commodity petroleum product for a period of time. Therefore, a method flexible enough to produce a variety of commodity petroleum products from a petroleum feedstock would be an advantage in meeting the demands of a changing marketplace and would further maximize the value of the commodity petroleum products.

Crude oil can be effectively used as an example. Crude oil is a complex mixture that is between 50% and 95% hydrocarbon by weight (depending on the source of the crude oil).

Generally, the first step in refining crude oil involves separating the crude oil into different hydrocarbon fractions, such as by distillation. A typical set of hydrocarbon fractions is given in Table 1. An analysis of Table 1 shows that gasoline has a hydrocarbon chain length of 5-12 carbon atoms and natural gas has a hydrocarbon chain length of 1-4 carbons while lubricants have a hydrocarbon chain length of 20 carbons and above and fuel oils have a hydrocarbon chain length of 14 and above. In order to maximize the value of a single barrel of crude oil, it would be advantageous to develop a process to convert the petroleum feedstock with longer hydrocarbon chain lengths into a desired commodity petroleum product with shorter hydrocarbon chain lengths, thereby maximizing the potential use and value for each barrel of crude oil. While commodity products with hydrocarbon chain lengths of 15 or less are generally desirable and more valuable, conditions in the marketplace may make the production of other commodity products more desirable.

In addition, certain types of petroleum feedstocks are not suitable for use as starting materials in petroleum refining operations. For example, bitumen is a complex mixture of hydrocarbon molecules that generally has a viscosity too great for use in standard petroleum refining techniques. Bitumen includes what are commonly referred to as tar and asphaltic components. However, if bitumen and other similar petroleum feedstocks could be treated to reduce the higher molecular mass components, they would become useful in petroleum refining operations and could yield a number of commodity petroleum products. Such a process is referred to as "petroleum upgrading". Therefore, it would be advantageous to develop a process to convert such complex hydrocarbon feedstocks to petroleum feedstocks and/or commodity petroleum products capable of further refining.

One important consideration for any method of processing petroleum feedstock to produce commodity petroleum products is the economic aspect. Current technologies exist that allow the processing of petroleum feedstocks with high hydrocarbon chain lengths into commodity petroleum products with shorter hydrocarbon chain lengths. However, many of these methods require substantial amounts of energy to be input into the system making them a less desirable alternative. In addition, many of the prior art processes are multi-stage processes requiring multiple steps and or multiple plants or facilities for the initial and subsequent processing. For example, a given process may require three steps to produce gasoline from a given petroleum feedstock and then require additional processes to remove contaminants from the produced gasoline or to enhance the performance characteristics of the gasoline. A one-step method of producing desired commodity petroleum products from a given petroleum feedstock would be of substantial value to the petroleum industry.

In order to achieve the above stated objectives, the prior art has utilized a variety of hydrocarbon cracking reactions to reduce the hydrocarbon chain length of various petroleum feedstocks. The main problem to be solved for effective processing of any type of petroleum feedstock via a cracking reaction is a problem of the control of the cracking reaction in conditions that provide combination of high processing rate and high conversion efficiency with a maximum simplicity, reduced capital expenditures for plant construction, maintenance and operation and economic efficiency at minimum energy expense.

As discussed above, only methods that allow the efficient propagation of hydrocarbon chain cracking reactions can provide the high processing rates necessary for industrial and commercial use. Furthermore, in one particular embodiment, such methods should utilize low pressures and temperatures during all phases of the cracking reaction in order to minimize operational costs and increase safety. Realization of such methods requires that the problems of cracking initiation and stimulation of chain cracking propagation at lowered temperatures be solved.

The present disclosure provides such a solution by providing a simple and efficient method for the self-sustaining radiation cracking of hydrocarbons. The method disclosed provides for the deep destructive processing of hydrocarbon chains utilizing hydrocarbon chain decomposition under a wide variety of irradiation conditions and temperature ranges (from room temperature to 450° C.). Several embodiments of such method are disclosed herein, including; (i) a special case of radiation-thermal cracking referred to as high-temperature radiation cracking (HTRC); (ii) low temperature radiation cracking (LTRC); and (iii) cold radiation cracking (CRC). The technological results of this disclosure include, but are not limited to: (i) the expansion of the sources of petroleum feedstocks for the production of commodity petroleum products; (ii) increasing the degree of petroleum feedstock conversion into usable commodity petroleum products; (iii) maximizing the yields of a variety of commodity petroleum products from petroleum feedstocks; (iv) upgrading the quality of various petroleum feedstocks; (v) and increasing the quality commodity petroleum products by minimizing undesirable contaminants (such as but not limited to sulfur) that may be present in the commodity petroleum products as a result of unwanted chemical reactions; (vi) increasing the stability of the commodity petroleum products produced by minimizing or preventing undesirable chemical reactions; (vii) providing a method flexible enough to produce a variety of commodity petroleum products from a given petroleum feedstock. The methods of the present disclosure provide these, and other benefits while reducing the energy required, simplifying the physical plant required to implement the methods and reducing the number of steps involved in the process as compared to prior art methods.

BRIEF DESCRIPTION OF THE FIGURES

FIG. 4A displays the results as changes in the fractional contents as determined by the number of carbon atoms in a molecule of the petroleum feedstock before (darker line) and after treatment (lighter line). FIG. 4B displays the results as changes in the boiling point ranges of the petroleum feedstock before (darker bars) and after treatment (lighter bars).

FIG. 4A displays the results as changes in the fractional contents as determined by the number of carbon atoms in a molecule of the petroleum feedstock before (darker line) and after treatment (lighter line). FIG. 4B displays the results as changes in the boiling point ranges of the petroleum feedstock before (darker bars) and after treatment (lighter bars)

FIG. 6A displays the results as changes in the fractional contents as determined by the number of carbon atoms in a molecule of the petroleum feedstock before (darker line) and after treatment (lighter line). FIG. 6B displays the results as changes in the boiling point ranges of the petroleum feedstock before (darker bars) and after treatment (lighter bars).

FIG. 7A displays the results as changes in the fractional contents as determined by the number of carbon atoms in a molecule of the petroleum feedstock before (darker line) and after treatment (lighter line). FIG. 7B displays the results as changes in the boiling point ranges of the petroleum feedstock before (darker bars) and after treatment (lighter bars).

FIG. 9A displays the results as changes in the fractional contents as determined by the number of carbon atoms in a molecule of the petroleum feedstock before (darker line) and after treatment (lighter line). FIG. 9B displays the results as changes in the boiling point ranges of the petroleum feedstock before (darker bars) and after treatment (lighter bars).

FIG. 11 displays the results as changes in the boiling point ranges of the petroleum feedstock before (darker bars) and after treatment (lighter bars).

FIGS. 12A and 12B display the results as changes in the fractional contents as determined by changes in the boiling point ranges of the petroleum feedstock before (darker bars) and after treatment (lighter bars).

FIG. 14 displays the results as changes in the boiling point ranges of the petroleum feedstock before (darker bars) and after treatment (lighter bars).

FIG. 15 displays the results as changes in the boiling point ranges of the petroleum feedstock before (darker bars) and after treatment with different irradiation doses (lighter bars).

FIG. 16 displays the results as changes in the fractional contents as determined by the number of carbon atoms in a molecule of the petroleum feedstock before (darker line), after treatment with the dose of 10 kGy and after 30 days of exposure (lighter lines).

FIG. 17 displays the results as changes in the boiling point ranges of the petroleum feedstock before (darker bars) and after treatment with different fractionated irradiation doses (lighter bars).

FIG. 18 displays the results as changes in the boiling point ranges of the petroleum feedstock before (darker bars) and after treatment with different irradiation doses (lighter bars).

FIG. 19 displays the results as changes in the boiling point ranges of the petroleum feedstock before (darker bars) and after treatment in static and flow conditions (lighter bars).

FIG. 20A displays the results as changes in the fractional contents as determined by the number of carbon atoms in a molecule of the petroleum feedstock before (darker line) and after treatment (lighter line). FIG. 20B displays the results as changes in the boiling point ranges of the petroleum feedstock before (darker bars) and after treatment (lighter bars).

DETAILED DESCRIPTION

Definitions

Figure 1:
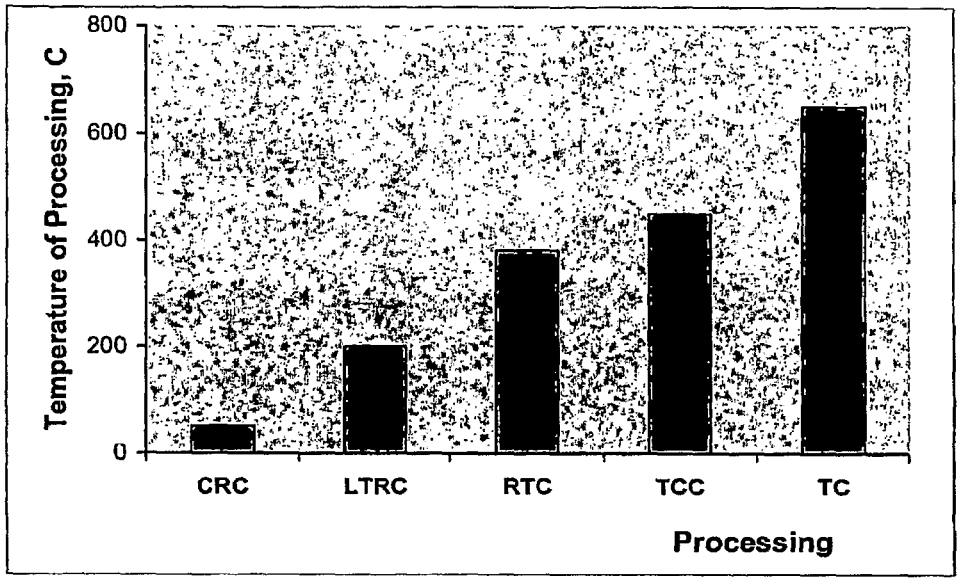
FIG. 1 shows the characteristic temperatures required for LTRC, CRC and the various prior art hydrocarbon cracking processes; LTRC=low temperature radiation cracking; CRC=cold radiation cracking; RTC=radiation-thermal cracking; TCC=thermocatalytic cracking; and TC=thermal cracking.

As used herein the following terms have the meanings set forth below.

"Petroleum feedstock" refers to any hydrocarbon based petroleum starting material, including, but not limited to, crude oil of any density and viscosity, high-viscous heavy crude oil, high-paraffin crude oil, fuel oil, tar, heavy residua of oil processing, wastes of oil extraction, bitumen, oil products of any density and viscosity, and used oil products.

"Treated petroleum feedstock" refers to a petroleum feedstock treated by HTRC, LTRC or CRC, wherein the petroleum feedstock so treated has an altered average hydrocarbon chain length of the hydrocarbon chains, an altered fractional composition and/or an altered chemical composition as compared to the untreated petroleum feedstock, said alteration occurring through one or more reactions including, but not limited to, hydrocarbon chain decomposition, polymerization, polycondensation, isomerization, oxidation, reduction and chemisorption; a treated petroleum feedstock may be used directly as a commodity petroleum product, as a starting material to generate commodity petroleum products, as a petroleum feedstock or as an upgraded petroleum feedstock.

"Commodity petroleum product" refers to a product for use derived, directly or indirectly, from a treated petroleum feedstock, from a petroleum feedstock treated by HTRC, LTRC or CRC or from an upgraded petroleum feedstock.

"Hydrocarbon molecule" refers to any chemical species in a petroleum feedstock containing carbon and hydrogen and capable of being altered by HTRC, LTRC or CRC treatment; exemplary chemical species include linear molecule composed of hydrogen and carbon, ring structures composed of hydrogen and carbon and combinations of the foregoing, as well as more complex chemical species composed of hydrogen and carbon.

"High-temperature radiation cracking" or "HTRC" refers to a process for the treatment of a petroleum feedstock, where said treatment is accomplished by feedstock irradiation at temperatures greater or equal to about 350° C. but less than or equal to about 450° C. and a time-averaged irradiation dose rate of about 5 kGy/s or higher resulting in a total absorbed dose of about 0.1 to about 3.0 kGy, wherein the total absorbed does is less than the limiting dose of irradiation as defined by the stability of the a treated petroleum feedstock and/or petroleum commodity products derived from the petroleum feedstock given the particular HTRC processing parameters and petroleum feedstock, said irradiation generating a self-sustaining chain reaction between chain carriers and excited molecules. HTRC shall be understood not to include reactions of hydrocarbon molecule decomposition that are not self-sustaining, such as, but not limited to, radiolysis and mechanical processing. However, HTRC can be accompanied by other non-destructive, non-self-sustaining reactions, such as but not limited to, polymerization, isomerization, oxidation, reduction and chemisorption, regulated by the special choice of processing conditions. HTRC may be used to generate a treated petroleum feedstock, a commodity petroleum product or an upgraded petroleum feedstock.

"Low-temperature radiation cracking" or "LTRC" refers to a process for the treatment of a petroleum feedstock, where said treatment is accomplished by feedstock irradiation at temperatures greater than about 200° C. and less than about 350° C. and a time-averaged irradiation dose rate of about 10 kGy/s or higher resulting in a total absorbed dose of about 1.0 to about 5.0 kGy, wherein the total absorbed does is less than the limiting dose of irradiation as defined by the stability of the produced treated petroleum feedstock and/or petroleum commodity products given the particular LTRC processing parameters and petroleum feedstock, said irradiation generating a self-sustaining chain reaction between chain carriers and excited molecules. LTRC shall be understood not to include reactions of hydrocarbon molecule decomposition that are not self-sustaining, such as, but not limited to, radiolysis and mechanical processing. However, LTRC can be accompanied by other non-destructive, non-self-sustaining reactions, such as but not limited to, polymerization, isomerization, oxidation, reduction and chemisorption, regulated by the special choice of processing conditions. LTRC may be used to generate a treated petroleum feedstock, a commodity petroleum product or an upgraded petroleum feedstock.

"Cold radiation cracking" or "CRC" refers to a process for the treatment of a petroleum feedstock, where said treatment is accomplished by feedstock irradiation at temperatures less than or equal to about 200° C. and a time-averaged irradiation dose rate of about 15 kGy/s or higher resulting in a total absorbed dose of about 1.0 to about 10.0 kGy, wherein the total absorbed does is less than the limiting dose of irradiation as defined by the stability of the produced treated petroleum feedstock and/or petroleum commodity products given the particular CRC processing parameters and petroleum feedstock, said irradiation generating a self-sustaining chain reaction between chain carriers and excited molecules. CRC shall be understood not to include reactions of hydrocarbon molecule decomposition that are not self-sustaining, such as, but not limited to, radiolysis and mechanical processing. However, CRC can be accompanied by other non-destructive reactions, non-self-sustaining reactions, such as but not limited to, polymerization, isomerization, oxidation, reduction and chemisorption, regulated by the special choice of processing conditions. CRC may be used to generate a treated petroleum feedstock, a commodity petroleum product or an upgraded petroleum feedstock.

"Chain reaction" as used in reference to HTRC, LTRC or CRC refers to a reaction between one or more chain carriers and one or more excited molecules, whereby the products of the initial reaction produce reaction products capable of further reactions with excited molecules.

"Chain carrier" refers to any molecular species produced by the action of irradiation on a petroleum feedstock and includes, but is not limited to free radicals, such as, but not limited to, H*, $CH_3$*, $C_2H_5$*; and the like and ionic species.

"Excited molecules" refers to those hydrocarbon molecules that have acquired excess energy sufficient for reaction with chain carriers, said energy being the result of thermal excitation and/or irradiation-induced excitation of the hydrocarbon molecules.

"Hydrocarbon molecule decomposition" refers to the reduction in size of at least a portion of the hydrocarbon molecules comprising a petroleum feedstock.

General

The present disclosure provides a simple and efficient method for the self-sustaining radiation cracking of hydrocarbons. The method disclosed provides for the deep destructive processing of hydrocarbon molecules utilizing hydrocarbon molecule decomposition utilizing self-sustaining radiation cracking of hydrocarbon molecules under a wide variety of irradiation conditions and temperature ranges (from room temperature to 400° C.). Several embodiments of such method are disclosed herein, including; (i) a special case of radiation-thermal cracking referred to as high-temperature radiation cracking (HTRC); (ii) low temperature radiation cracking (LTRC); and (iii) cold radiation cracking (CRC). Such methods were not heretofore appreciated in the art. In one embodiment, a petroleum feedstock is subjected to irradiation to initiate and/or at least partially propagate a chain reaction between components of the petroleum feedstock. In one embodiment, the treatment results in hydrocarbon molecule decomposition; however, other chemical reactions as described herein may also occur.

The methods are carried out in a suitable reactor at the desired temperature, a desired dose of radiation and a desired dose rate of radiation using a desired petroleum feedstock. The parameters of temperature, dose and dose rate may be easily varied by the user as well as the nature of the petroleum feedstock. Furthermore, reaction may be varied by the addition of one or more agents to the petroleum feedstock and/or by additional processing of the petroleum feedstock. The petroleum feedstock may be subject to such agents and additional processing either prior to processing as described herein and/or during such processing. In one embodiment, the agent is ionized air, steam, ozone, oxygen, hydrogen, methanol, and methane; the above list is not inclusive and other gases, vapors and liquids may be used as agents in the present disclosure. In one embodiment, the additional processing may involve subjecting the petroleum feedstock to thermal, mechanical, acoustic or electromagnetic processing. By varying the temperature, dose, dose rate, petroleum feedstock, the agent and/or additional feedstock processing, the rate and yield of the radiation cracking chain reaction, as well as the production of desired commodity petroleum products, the final viscosity of the treated petroleum feedstock, the degree of conversion of the petroleum feedstock and the stimulation of alternate chemical reactions (such as but not limited to polymerization, polycondensation, isomerization, oxidation, reduction, and chemisorption) may be controlled by the user.

In one embodiment, the method proceeds, at least in part, by a chain reaction which results in hydrocarbon molecule decomposition; the method may also involve other chemical processes such as, but not limited to, polymerization, polycondensation, isomerization, oxidation, reduction and chemisorption. Such alternative chemical processes may impart useful properties to the treated petroleum feedstock.

The radiation source generates particles having a predetermined average energy and energy distribution. The petroleum feedstock is exposed to a sufficient particle current density of said particles such that the rate of energy absorbed per unit of petroleum feedstock mass is sufficient for initiation and/or propagation of HTRC, LTRC or CRC and energy absorbed per unit of petroleum feedstock mass is sufficient for the required degree of conversion to desired commodity petroleum products and/or to impart desired characteristics to the treated petroleum feedstock. In one embodiment, the dose and/or dose rate is determined based on the characteristics of the pulsed or continuous irradiation, the degree of treatment required, the final viscosity of the treated petroleum feedstock and/or the type of commodity petroleum product desired.

Petroleum feedstock may be irradiated in either in a continuous or pulsed mode. In one embodiment, the radiation source is an electron accelerator producing an electron beam comprising electrons having of energy in the range of about 1 to about 10 MeV and the petroleum feedstock is exposed to a sufficient electron beam current density such that the time averaged dose rate is about 5 kGy/s or greater. The method proceeds from about atmospheric pressure to 3 atmospheres, although higher or lower pressures may be used as desired it being understood that higher and lower pressures will increase the complexity of the physical processing plant and the energy costs involved. As a result of HTRC, LTRC or CRC, the petroleum feedstock is converted to a treated petroleum feedstock having one or more desired properties or a desired set of commodity petroleum products. The treated petroleum feedstock can be further processed to separate and/or isolate various fractions. Such fractions may be used directly as commodity products or used in further purification or processing reactions. Alternatively, the treated petroleum feedstock may be transported, due to its improved characteristics, by means known in the art for further processing, using methods known in the prior art or the methods disclosed herein The methods disclosed herein combine unique combinations of temperature, absorbed dose of radiation, and dose rate of irradiation in order to initiate and/or maintain the described chain reactions. HTRC, LTRC and CRC are high-rate chain reactions that are suitable for industrial scale use. In one embodiment, HTRC, LTRC and CRC induce the hydrocarbon molecule decomposition. The hydrocarbon molecule decomposition can also be accompanied by alternate chemical reactions as discussed herein. Furthermore, HTRC, LTRC and CRC are effective with a wide range of petroleum feedstocks, including but not limited to, high-viscous crude oil, bitumen and high-paraffinic oil. Therefore, HTRC, LTRC and CRC methods may be used in a variety of industrial settings with a wide variety of petroleum feedstocks.

Several methods of radiation self-sustaining cracking are disclosed herein, including HTRC, LTRC and CRC. As discussed above, by varying the parameters of the radiation self-sustaining cracking (such as, but not limited to, temperature, total absorbed dose, dose rate, type of petroleum feedstock, the use of agents and/or additional feedstock processing) the rate and yield of the radiation cracking chain reaction, as well as the production of desired commodity petroleum products, the final viscosity of the treated petroleum feedstock, the degree of conversion of the petroleum feedstock and the stimulation of alternate chemical reactions (such as but not limited to polymerization, polycondensation, isomerization, oxidation, reduction, and chemisorption) may be controlled by the user. In each method, the total absorbed dose of irradiation is selected so that the total absorbed dose is less than the limiting dose of irradiation, as defined by the stability of the treated petroleum feedstock, the commodity petroleum products desired to be produced or the desired characteristics of the treated petroleum feedstock. The limiting dose of radiation can be impacted by the other parameters of the reaction, such that the limiting dose of radiation for a particular feedstock can be different if the other parameters of the reaction are varied.

In one embodiment, the self-sustaining cracking reaction is HTRC. In an alternate embodiment, the self-sustaining cracking reaction is LTRC. In yet another alternate embodiment, the self-sustaining cracking reaction is CRC. For HTRC, the petroleum feedstock is irradiated at temperatures greater or equal to about 350° C. but less than or equal to about 450° C. using a time-averaged irradiation dose rate of 5 kGy/s or higher with a total absorbed dose of 0.1 to 3.0 kGy. In one embodiment the temperature range is greater or equal to about 350° C. but less than or equal to about 400°. For LTRC the petroleum feedstock is irradiated at temperatures greater than about 200° C. and less than about 350° C. using a time-averaged irradiation dose rate of 10 kGy/s or higher with a total absorbed dose of 1.0 to 5.0 kGy. For CRC the petroleum feedstock is irradiated at temperatures less than or equal to about 200° C. using a time-averaged irradiation dose rate of 15 kGy/s or higher with a total absorbed dose of 1.0 to 10.0 kGy. In one embodiment, the temperature is less than about 100° C.; in a further alternate embodiment, the temperature is about room temperature; in still a further embodiment, the temperature is about 20° C.

In each of HTRC, LTRC and CRC, the irradiation initiates and/or partially sustains a high-rate self sustaining chain reaction between chain carriers and excited molecules. HTRC, LTRC and CRC shall be understood not to include reactions of hydrocarbon molecule decomposition that are not self-sustaining, such as, but not limited to, radiolysis and mechanical processing. However, HTRC, LTRC and CRC can be accompanied by other non-destructive, non-self-sustaining reactions, such as but not limited to, polymerization, isomerization, oxidation, reduction and chemisorption, regulated by the special choice of processing conditions.

In each of HTRC, LTRC and CRC the total absorbed dose of irradiation is less than the limiting dose of irradiation as defined by the stability of the treated petroleum feedstock, the commodity petroleum products produced or the desired characteristics of the treated petroleum feedstock. In addition, for each of HTRC, LTRC and CRC additional agents may be added before and/or during processing and/or the petroleum feedstock may be treated with a secondary process before and or during processing, each as described herein.

Certain characteristics of HTRC, LTRC and CRC may make each process a better choice depending on the results desired and the starting material available. The production rate of a radiation facility (kg/s), designated Q, can be evaluated using formula $$Q = \alpha\eta\frac{N}{D},$$

where N is electron beam power (kW); D is the dose (kJ/kg); $\eta$ is the accelerator efficiency (for many types of electron accelerators $\eta$=0.8-0.85); $\alpha$ is coefficient that takes into account beam power losses (it is usually assumed that $\alpha \approx 1/3$). As can be seen, for the given characteristics of an electron accelerator the facility production rate depends only on the dose required for the process.

The rates of irradiation-induced reactions of chain initiation and chain propagation increase as the dose rate, P, increases. Therefore, the dose necessary for the given degree of petroleum feedstock conversion depends on the dose rate. In the case of radiation-thermal cracking this dose is proportional to $P^{-1/2}$, while in the case of CRC it is proportional to $P^{-3/2}$. The stronger dependence D(P) for the CRC provides industrial scale processing of petroleum feedstock at low temperatures but heightened dose rates of electron irradiation.

CRC provides the most economic process by allowing the highest degree of energy saving through the elimination of energy expenses for the petroleum feedstock heating. Application of HTRC and LTRC assumes preliminary petroleum feedstock heating to the temperatures up to about 450° C. and 350° C., respectively, that is associated with additional energy consumption compared with CRC. However, in the case of LTRC, and to a lesser extent HTRC, energy expense for petroleum feedstock heating is much lower than that characteristic for conventional thermocatalitic or radiation-thermal cracking due to the increased and controllable yields of commodity petroleum products produced. At the same time, due to additional thermal excitation of hydrocarbon molecules, the HTRC and LTRC reaction rate and, therefore, production rate is higher compared with CRC at the same dose rate of electron irradiation. Moreover, HTRC and LTRC maintain temperature as an additional parameter for initiation and control of thermally activated reactions with low activation energies at relatively low temperatures; the latter can be useful for provision of the desired properties of products obtained from the special types of petroleum feedstock.

Principle of Hydrocarbon Cracking

For any hydrocarbon molecule cracking reaction, two stages are required (as discussed in the Background): (i) the initiation stage; and (ii) the propagation stage. Each of the initiation and propagation stages can be characterized by the specific chemistry that occurs in each reaction. The initiation stage comprises the formation and maintenance of chain carriers. The concentration of chain carriers produced during the initiation stage increases with the dose of the radiation absorbed by the petroleum feedstock.

The chain carriers are produced at a concentration sufficient to initiate the chain reaction process. In one embodiment, a dose rate of ionizing radiation greater than or equal to about 1 kGy/s is sufficient to produce a sufficient concentration of chain carriers to initiate the high rate chain reaction process. Principally, 1 kGy per second is sufficient for initiation of the cracking reaction (but not for its propagation). It should be noted that while 1 kGy/s is sufficient, higher dose rates will result in higher reaction rates.

The propagation stage comprises the formation and maintenance of concentrations of excited molecules necessary for the propagation of the chain reaction and the maintenance of the self sustaining chain reaction. In one embodiment, excited molecules are generated entirely through excitation induced by the irradiation. In an alternate embodiment, the excited molecules are generated through excitation induced by the irradiation and other mechanisms such as, but not limited to, pre-heating the petroleum feedstock to temperatures less than 150 C, mechanical, acoustic or electromagnetic processing. In one embodiment, a dose rate of ionizing radiation greater than about 5 kGy/s is sufficient to solely produce a sufficient concentration of excited molecules to propagate the chain reaction. In embodiments where the dose rate of ionizing radiation is less than 5 kGy/s, the production and maintenance of excited molecules requires additional mechanisms as set forth above.

In the HTRC, LTRC and CRC methods described herein, the initiation stage and the propagation stage can be carried out at temperatures from 20° C. to 450° C. and from about atmospheric pressure to 3 atmosphere. While the reaction vessel in which the HTRC, LTRC and CRC processes occur is not pressurized, gas evolution generated during such processes can increase the pressure in the reaction vessel to greater than atmospheric pressure. Therefore, in certain embodiments of the methods disclosed herein (such as LTRC and CRC), the initiation and propagation stages can be carried out without any thermal activation of the chain propagation reaction, although thermal enhancement may also be used. In HTRC, the temperature is sufficient for thermal activation of the chain propagation reaction. However, as distinct from the methods of the prior art, such as RTC, the rate of the HTRC reaction and the limiting dose of radiation is regulated by the variation of the dose rate in the range of greater than about 5 kGy/s and through additional treatment with processes such as, but not limited to, pre-heating the petroleum feedstock to temperatures less than 150° C., mechanical, acoustic or electromagnetic processing, to structurally and/or chemically modify the petroleum feedstock. It should be noted that the temperatures of less than about 350° C. are not sufficient for thermal activation of the chain propagation reaction as is used in prior art cracking methods such as RTC; however, when combined with irradiation as described herein, thermal enhancement of chain propagation may occur due to enhanced chain carrier diffusion, which enhances the chain reaction initiated by the irradiation as provided herein. Furthermore, the concentration of the excited molecules produced by the action of irradiation can be achieved using dose rate of ionizing radiation described herein.

In the case of CRC, the initiation stage and the propagation stage require only the energy provided by the ionizing radiation. In the CRC process both chain carriers and excited molecules are produced by the interaction of the ionizing radiation at a predetermined dose rate with the petroleum feedstock at temperatures below or equal to about 200° C. The chain carriers can then be used to initiate the propagation stage. Under these conditions, concentrations of chain carriers and excited molecules generated by irradiation are sufficient for the high rate of chain reaction. Since no or minimal thermal heating is required, treatment of the petroleum feedstock can be carried out at the temperatures unusually low for hydrocarbon molecule cracking reactions.

However, dependence of the hydrocarbon molecule cracking reaction rate on the radiation dose rate is different for RTC and CRC. In the case of RTC dependence of the cracking rate, W, on the radiation dose rate, P, can be written in the form of equation 1 below:

$$W \sim P^{1/2} \quad (1)$$

In the case of CRC dependence of the cracking rate, W, on the radiation dose rate, P, can be written in the form of equation 2 below:

$$W \sim P^{3/2} \quad (2)$$

In this dependence radiation generation of excited molecules at heightened dose rates is taken into account. As can be seen in comparing equations (1) and (2), an increase in the radiation dose rate P provokes a significant increase in the reaction rate observed in CRC at any temperature. This enhanced reaction rate makes CRC applicable in the industrial scale. The same and higher enhanced reaction rate also applies to HTRC and CRC.

HTRC and LTRC utilize the heightened dose rates described herein and at a temperature in the range of about 350-450° C. for HTRC and about 200-350° C. for LTRC. The activation energy of the HTRC process is about 80,000 J/mole and about 8600 J/mole for the LTRC process, which corresponds to activation energy for diffusion of light molecules characteristic for liquid hydrocarbon. The contribution of the added thermal energy in HTRC and LTRC increases the diffusion of the chain carriers and increases the reaction rate of hydrocarbon molecule cracking observed in LTRC.

Practical application of HTRC and LTRC allows realization of radiation-initiated cracking for any type of petroleum feedstock at temperatures of greater than about 200° C. and provides high reaction rates such that the process can be utilized on a commercial scale.

Comparison of the prior art cracking processes to the HTRC, LTRC and CRC processes described herein are provided in Table 2. As can be seen, the mechanisms responsible for the chain propagation stage are different in HTRC, LTRC and CRC and the prior art methods. The reduction in the temperatures used in LTRC and CRC significantly reduces energy consumption requirements per ton of petroleum feedstock in the LTRC and CRC methods as compared to the prior art methods as shown in Table 2. The characteristic temperatures used for LTRC, CRC and the prior art cracking methods are shown in FIG. 1 (RTC indicates radiation-thermal cracking, TCC indicates thermocatalytic cracking, TC indicates thermal cracking and LTRC and CRC are as previously defined). As can be observed, the temperature requirements for RTC, TCC and TC are about 10-50 fold higher than those required for CRC and 2-3 fold higher than those required for LTRC. This reduction in energy consumption reduces the economic costs associated with the LTRC and CRC processes, and when combined with the high reaction rates, makes LTRC and CRC attractive from a commercial standpoint. Furthermore, while the temperatures used in HTRC are comparable to the temperatures used in RTC, the higher reaction rate induced by the increased dose rate and structural and/or chemical modification of the petroleum feedstock with processes such as, but not limited to, pre-heating the petroleum feedstock, mechanical, acoustic or electromagnetic processing, result in a more efficient process in terms of the characteristics of the treated petroleum feedstocks and the commodity petroleum products produced.

Irradiation Modes

The reaction rate in HTRC, LTRC and CRC is dependent on the characteristics of the irradiating particles. The irradiation may be provided in a continuous or a non-continuous mode.

In one embodiment, the non-continuous mode is a pulsed mode with the pulse having an average pulse width and an average frequency. In one embodiment, the average pulse width is from 1-5 μs and the average frequency is from 30-600 $s^{-1}$.

In one embodiment, the irradiation is provided by an electron accelerator. In this embodiment, the reaction rate in HTRC, LTRC and CRC is dependent, in part, on the characteristics of the particles comprising the electron beam. In this embodiment, the electron accelerator produces electrons to irradiate the petroleum feedstock, with said electrons having an energy of from 1 to 10 MeV.

Figure 2:
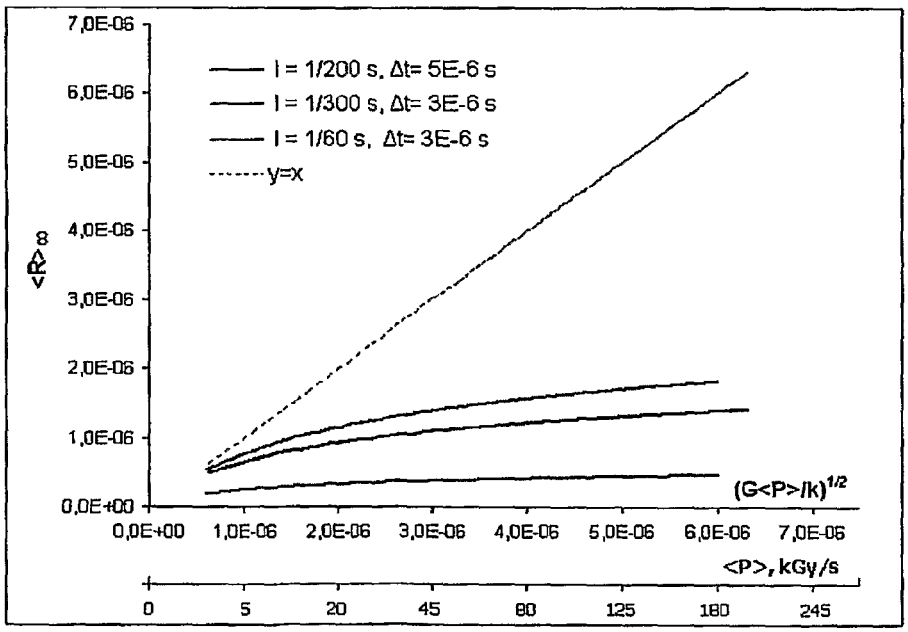
FIG. 2 shows the dependence of chain carrier concentration on the characteristics of the electron beam at an equivalent time averaged dose rate for 3 modes of pulsed irradiation having differing pulse width and/or frequency (3 μs, 300 $s^{-1}$—upper curve; 5 μs, 200 $s^{-1}$—middle curve; 3 μs, 60 $s^{-1}$—lower curve) and for continuous irradiation (dash line).

FIG. 2 shows the calculated dependence of quasi-stationary radical concentration in three different pulsed (i.e. non-continuous) irradiation modes on the stationary radical concentration at the same average dose rate in the continuous irradiation mode. The non-continuous mode characterized by the lowest pulse width and frequency (3 μs, 60 $s^{-1}$) differs the most from the continuous irradiation mode. The two additional non-continuous modes (3 μs, 300 $s^{-1}$ and 5 μs, 200 $s^{-1}$) give the results close to continuous irradiation when dose rates are relatively low. When the dose rate in a pulse is lower than $2\times10^6$ Gy/s, the corresponding radical concentrations differ by less than 25%. At high dose rates the quasi-stationary time-averaged radical concentration depends on the square root of the time-averaged dose rate according to the logarithmic law, and its difference from the stationary radical concentration in the continuous irradiation mode rapidly increases with the dose rate.

As can be seen in FIG. 2, the continuous mode of electron radiation provides a higher concentration of chain carriers, and consequently excited molecules, than the non-continuous modes. However, both continuous and non-continuous modes of irradiation can be used in LTRC and CRC as described herein.

Process

The technological scheme for treatment petroleum feedstock and methods for reaction control are based on the fundamental regularities of radiation-chemical conversion.

The HTRC, LTRC and CRC methods provide for the efficient transfer of irradiation energy to hydrocarbon molecules in a petroleum feedstock. The mechanism and kinetics for interaction of chain carriers and excited molecules can be considered as universal with respect to all petroleum feedstocks, including but not limited to oil petroleum feedstocks, such as but not limited to, heavy crude oil, heavy residua of oil processing, bitumen extracts, etc. For realization of HTRC, LTRC and CRC, a desired petroleum feedstock is supplied to a radiation-chemical reactor vessel. The petroleum feedstock may be supplied in a liquid form, a gas form, a solid form or a combination of the foregoing. In one embodiment, the petroleum feedstock is supplied in a liquid form. The reactions required for the HTRC, LTRC and CRC processes occur in the radiation-chemical reactor vessel.

Figure 3:
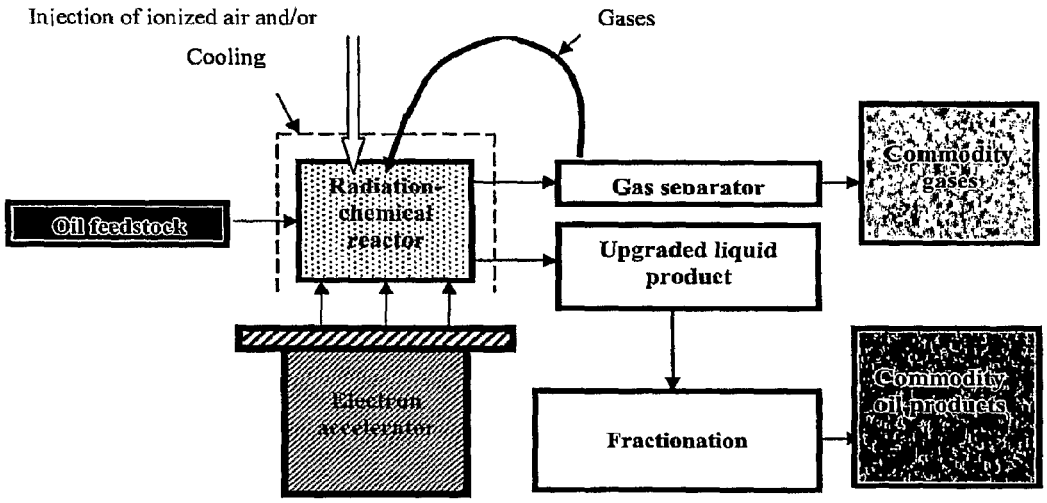
FIG. 3 shows an exemplary schematic of one embodiment of the LTRC and CRC processes.

The general scheme for the HTRC, LTRC and CRC process is given in FIG. 3. In the reactor vessel, the petroleum feedstock is irradiated by particles having a defined energy produced by a radiation source. The petroleum feedstock is exposed to the particles with a defined energy for a defined time so that the absorbed radiation dose rate is sufficient to initiate and/or sustain the CRC process and the dose is sufficient to provide the required degree of petroleum feedstock treatment.

The reactor vessel may be any vessel that is known in the art. A typical reaction vessel will comprise an input window to allow the irradiation to enter. The input window generally corresponds to the area of the electron beam sweep. In one embodiment the input window is 100×15 $cm^2$. However, other dimensions may be used as desired.

For the various methods described below, the petroleum feedstock may be introduced into the reactor vessel using any technique known in the art. In one embodiment, the petroleum feedstock is introduced by injection into the reactor vessel in a dispersed form, such as via an atomizer. As discussed below, the petroleum feedstock may be treated with an agent to enhance the reaction (such as but not limited to ionized air, steam, ozone, oxygen, hydrogen, methane and methanol, or other gases/vapors/liquids) or subject to structural and/or chemical modification using an additional processing step (such as but not limited to thermal, mechanical, acoustic or electromagnetic processing). Said agent may be added or said additional processing may occur before processing, during processing or both. The additional processing is referred to herein as modification of the petroleum feedstock. Modification of the petroleum feedstock is optional.

However, the limiting dose or irradiation and the reaction rate may be varied through the use of the optional modification. Furthermore, the limiting dose or irradiation and the reaction rate may be varied through altering the time-averaged irradiation dose rate and the flow condition parameters.

In the CRC process the petroleum feedstock temperature is in the range of about 20° C. to about 200° C. In one embodiment, petroleum feedstock temperature is not higher than about 70° C. In an alternate embodiment, petroleum feedstock temperature is not higher than about 50° C. In yet another alternate embodiment, petroleum feedstock temperature is not higher than about room temperature. The petroleum feedstock may be irradiated in a static (no flow of petroleum feedstock) state or a non-static (with flow of the petroleum feedstock) state. In the non-static state, the petroleum feedstock flow rate through the reactor vessel is maintained at a flow rate such that the exposure time of the petroleum feedstock is the minimal time required for the petroleum feedstock to absorb a total dose of radiation, at a given dose rate and temperature, to initiate and/or sustain the initiation and/or propagation stages of CRC. The flow rate may be maintained at a constant rate or varied and may depend on the volume of the petroleum feedstock being treated. Generally, the higher the energy of the particle (such as an electron) used to provide the irradiation, the lower the flow rate can be for the given rate of processing, given dose rate and/or absorbed dose. At a given flow rate, the linear velocity of the flow and the depth of the petroleum feedstock layer subject to irradiation can be varied. In one embodiment, the flow rate is between about 10 and 200 kg/hour, the linear flow velocity is between 10 and 50 m/s and the depth of the petroleum feedstock being irradiated is from about 0.5 to 4 mm. The maximal depth of the petroleum feedstock is defined by the depth of the particle penetration into the petroleum feedstock and depends on the energy of the particle. For example, for an electron with an energy of 7 MeV, the depth of particle penetration is about 4 cm.

In one embodiment of CRC, the irradiation is provided as a pulsed electron beam or a continuous electron beam as described herein and the particles are electrons. The electron beam may be produced by an electron accelerator. In one embodiment of the CRC process, a continuous mode of irradiation is used. The electrons may have energies within the range of about 1-10 MeV. In one embodiment the irradiation dose rates used in the CRC process are above about 15 kGy/s, the total absorbed dose of irradiation is from about 1.0 to about 10.0 kGy and the total absorbed dose is less than the limiting dose of irradiation, as defined by the stability of the treated petroleum feedstock, the commodity petroleum products desired to be produced or the desired characteristics of the treated petroleum feedstock. As would be obvious to one of ordinary skill in the art, it is advantageous to maintain the absorbed dose of radiation and the time of exposure to a minimum required to achieve the desired objective.

For LTRC, the petroleum feedstock may be supplied to a reactor vessel as described above for the CRC process. LTRC of the petroleum feedstock is carried out using the same technological scheme and the same radiation-chemical reactor vessel as shown in FIG. 3 and described above in relation to the CRC process. However, in LTRC, the petroleum feedstock is heated up to a temperature from about 200 to about 350° C. In LTRC, as with CRC, in the reactor vessel the petroleum feedstock comes into contact with particles having a defined energy produced by a radiation source. The petroleum feedstock is exposed to the particles with a defined energy for a defined time so that the absorbed radiation dose rate is sufficient to initiate and/or sustain the LTRC process and the dose is sufficient to provide the required degree of petroleum feedstock treatment. The petroleum feedstock may be irradiated in a static (no flow of petroleum feedstock) state or a non-stack (with flow of the petroleum feedstock) state. In the non-static state, the petroleum feedstock flow rate through the reactor vessel is maintained at a flow rate such that the exposure time of the petroleum feedstock is the minimal time required for the petroleum feedstock to absorb a dose of radiation, at a given dose rate and temperature, to initiate and/or sustain the initiation and/or propagation stages of the LTRC reaction. The flow rate may be maintained at a constant rate or varied and may depend on the volume of the petroleum feedstock being treated. Generally, the higher the energy of the particle (such as an electron) used to provide the irradiation, the lower the flow rate can be for the given rate of processing, given dose rate and/or absorbed dose. At a given flow rate, the linear velocity of the flow and the depth of the petroleum feedstock layer subject to irradiation can be varied. In one embodiment, the flow rate is between about 10 and 200 kg/hour, the linear flow velocity is between 10 and 50 m/s and the depth of the petroleum feedstock being irradiated is from about 0.5 to 4 mm. The maximal depth of the petroleum feedstock is defined by the depth of the particle penetration into the petroleum feedstock and depends on the energy of the particle. For example, for an electron with an energy of 7 MeV, the depth of particle penetration is about 4 cm.

In one embodiment, petroleum feedstock is irradiated with pulsed electron beam. The pulsed electron beam may be produced by an electron accelerator. For the LTRC process, a continuous or pulsed mode of irradiation is used. When the petroleum feedstock is heated to a temperature at or below about 250° C., a continuous mode of irradiation is preferred. However, when the petroleum feedstock is heated to temperatures above 250° C. either a pulsed or continuous mode of irradiation may be used. However, a continuous mode of irradiation provides a higher production rate. The electrons may have energies within the range of about 1-10 MeV. In one embodiment the irradiation dose rates used in the LTRC process are above about 10 kGy/s, the total absorbed dose of irradiation is from about 1.0 to about 5.0 kGy and the total absorbed dose is less than the limiting dose of irradiation, as defined by the stability of the treated petroleum feedstock, the commodity petroleum products desired to be produced or the desired characteristics of the treated petroleum feedstock. As would be obvious to one of ordinary skill in the art, it is advantageous to maintain the total absorbed dose of radiation, and the time of exposure to a minimum required to achieve the desired objective.

For HTRC, the petroleum feedstock may be supplied to a reactor vessel as described above for the CRC process. HTRC of the petroleum feedstock is carried out using the same technological scheme and the same radiation-chemical reactor vessel as shown in FIG. 3 and described above in relation to the CRC process. However, in LTRC, the petroleum feedstock is preheated and processed up to a temperature from about 350 to about 450° C. In HTRC, as with CRC, in the reactor vessel the petroleum feedstock comes into contact with particles having a defined energy produced by a radiation source. The petroleum feedstock is exposed to the particles with a defined energy for a defined time so that the absorbed radiation dose rate is sufficient to initiate and/or sustain the HTRC process at the prescribed dose rate and the dose is sufficient to provide the required degree of petroleum feedstock treatment. The petroleum feedstock may be irradiated in a static (no flow of petroleum feedstock) state or a non-static (with flow of the petroleum feedstock) state. In the non-static state, the petroleum feedstock flow rate through the reactor vessel is maintained at a flow rate such that the exposure time of the petroleum feedstock is the minimal time required for the petroleum feedstock to absorb a dose of radiation, at a given dose rate and temperature, to initiate and/or sustain the initiation and/or propagation stages of the HTRC reaction. The flow rate may be maintained at a constant rate or varied and may depend on the volume of the petroleum feedstock being treated. Generally, the higher the energy of the particle (such as an electron) used to provide the irradiation, the lower the flow rate can be for the given rate of processing, given dose rate and/or absorbed dose. At a given flow rate, the linear velocity of the flow and the depth of the petroleum feedstock layer subject to irradiation can be varied. In one embodiment, the flow rate is between about 10 and 200 kg/hour, the linear flow velocity is between 10 and 50 m/s and the depth of the petroleum feedstock being irradiated is from about 0.5 to 4 mm. The maximal depth of the petroleum feedstock is defined by the depth of the particle penetration into the petroleum feedstock and depends on the energy of the particle. For example, for an electron with an energy of 7 MeV, the depth of particle penetration is about 4 cm.

In one embodiment, petroleum feedstock is irradiated with pulsed electron beam. The pulsed electron beam may be produced by an electron accelerator. For the HTRC process, a continuous or pulsed mode of irradiation is used. In the case of HTRC, either a pulsed or continuous mode of irradiation may be used. The electrons may have energies within the range of about 1-10 MeV. In one embodiment the irradiation dose rates used in the HTRC process are above about 5 kGy/s, the total absorbed dose of irradiation is from about 0.1 to about 2.0 kGy and the total absorbed dose is less than the limiting dose of irradiation, as defined by the stability of the treated petroleum feedstock, the commodity petroleum products desired to be produced or the desired characteristics of the treated petroleum feedstock. As would be obvious to one of ordinary skill in the art, it is advantageous to maintain the total absorbed dose of radiation, and the time of exposure to a minimum required to achieve the desired objective.

In the above reactions, as further exemplified in the following examples, the limiting dose of radiation and the reaction rate is a function of the time-averaged irradiation dose rate and the modification to the petroleum feedstock, which is optional. By varying one or all of these parameters the limiting dose of radiation and the reaction rate can be altered. In one embodiment, modification of the petroleum feedstock allows the time-averaged irradiation dose rate to be decreased while maintaining the reaction rate and the overall yield of the reaction.

Furthermore, in the above reactions the treatment in flow conditions provides a radiation chemical yield of light fractions of not less than 100 molecules per 100 eV applied to the reaction. Light fractions in this regard refer to those species in the treated petroleum feedstock, commodity petroleum product or upgraded petroleum feedstock having a carbon chain of 14 carbons or less. The method of calculating radiation chemical yield is described in [2].

The radiation-chemical yield, G, is defined as the number of product molecules (or the number of reacted feedstock molecules) per 100 eV of consumed irradiation energy. In the case processing reactions that do not utilize a self-sustaining chain reaction as set forth in the present disclosure, characteristic G values are 3-5 molecules/100 eV. In the case processing reactions that utilize a self-sustaining chain reaction as set forth in the present disclosure, G can vary in the range from about 10 to about 20,000 molecules/100 eV (see Examples below).

$$G, \frac{\text{molecules}}{100\ \text{eV}} = \frac{100eN_A}{PM}W$$

where NA is the Avogadro number, e is the electron charge, P is the dose rate, M, in kg/mole, is the average molecular mass of the product or the feedstock, depending on which radiation-chemical yield is being determined and W is the initial rate of cracking reaction, s-1:

$$W = \frac{dY}{dt}\Big|_{t=0}$$

where t is time, Y is the relative share of reacted feedstock molecules or accumulated product molecules).

Finally, in the above reactions, to prevent heating of metal parts of the radiation-chemical reactor vessel, water and/or liquid nitrogen cooling may be used if desired. When more homogeneous irradiation and higher reaction rates are desired, the petroleum feedstock may be injected to the reaction camera in a dispersed form through atomizers or water vapor (such as steam) and/or ionized (ozone containing) air may be injected into the reactor vessel. The ionized air used for injection may be obtained as a by product of the electron accelerator operation. The water vapor and/or ionized air may be pumped into the reactor vessel during irradiation of the petroleum feedstock or may be bubbled into the petroleum feedstock before introduction into the reactor vessel. In a particular embodiment where the ionized air is introduced into the petroleum feedstock into in the reactor vessel during radiation processing, the irradiation dose rates may be decreased 4-20 fold, or in the case of CRC to the 1-5 ky/s range. Therefore, irradiation doses can be reduced and production rates can be increased 4-20 fold.

The product of HTRC, LTRC and CRC processes are a treated petroleum feedstock, a commodity petroleum product and/or an upgraded petroleum product. The treated petroleum feedstock may comprise an upgraded liquid fraction and/or an upgraded gaseous fraction (such as but not limited to hydrogen, methane, ethylene and other gases). The upgraded liquid and/or gaseous fraction may contain a single component or multiple components which can be further isolated. By upgraded, it is meant that the liquid or gaseous fractions have, on average, shorter hydrocarbon molecule lengths than found, on average, in the petroleum feedstock or these fractions have upgraded properties (e.g. higher gasoline octane numbers, a desired polymeric composition or a desired isomer composition). The upgraded gaseous fraction may be transferred from the reactor vessel to a gas separator in communication with the reactor vessel to separate the various gaseous fractions into commodity gaseous products. The gas separator can be any gas separator currently known or known in the future as the exact operation of the gas separator is not critical to the present disclosure. The commodity gaseous products may be used for a variety of purposes, such as petroleum feedstocks for the chemical industry. The upgraded liquid fraction is transferred from the reactor vessel to a device for fractionation of the upgraded liquid fraction into commodity products. The device for fractionation is in communication with the reactor vessel. The device for fractionation can be any device currently known or known in the future as the exact operation of the device is not critical to the present disclosure. In an alternate embodiment, the upgraded liquid fraction can be used directly for further processing reactions (such as a synthetic crude oil) or can be used directly as a commodity product. Alternatively, the treated petroleum feedstock may be transferred to another facility for further processing, using prior art methods or the methods of the present disclosure. The use of HTRC, LTRC and/or CRC may result in the treated petroleum feedstock having desired characteristics, such as, but not limited to, decreased viscosity, that allow the treated petroleum feedstock to be transported.

Furthermore, in the case where the HTRC, LTRC or CRC process is accompanied by considerable gas evolution, for example when the petroleum feedstock is a high-paraffinic petroleum feedstock, gases produced may be partially recycled through the HTRC, LTRC or CRC process and used for upgrading the products of the process.

Therefore, through the use of HTRC, LTRC and CRC, the economic treatment of petroleum feedstocks is accomplished on an industrial scale. As a result, many previously unusable petroleum feedstocks may be converted into usable petroleum feedstocks to produce a variety of commodity products. Furthermore, through hydrocarbon molecule decomposition, the recovery of shorter chain hydrocarbon fractions may be increased and the properties associated with shorter chain hydrocarbon fractions, such as increased viscosity, may be increased. The HTRC, LTRC and CRC processes allow this transformation at a minimum energy expense. The energy consumed for electron accelerator operation is significantly lower than the energy required for petroleum feedstock heating RTC and TC, as well as other prior art hydrocarbon molecule cracking processes. The reduction in energy expense leads to a corresponding decrease in operational costs for petroleum feedstock processing and also to potentially lower cost for the commodity goods derived therefrom.

In addition to the economic benefits, the use of HTRC, LTRC and CRC provide other benefits as well. Since these processes occur at pressures from about atmospheric pressure to 3 atmospheres, the process is safer than prior art hydrocarbon cracking processes. Specifically, the risks of explosions and accidental leakage are significantly reduced. Furthermore, the costs of equipment and equipment maintenance are reduced since the HTRC, LTRC and CRC processes operate at lowered pressure and lowered temperatures. Yet another benefit relates to the low temperatures used in the LTRC and CRC process. The low temperature reactions reduce unwanted chemical processes that occur at higher temperatures, such as coking and polymerization. Furthermore, while higher temperatures are used in the HTRC process, the additional parameters of the HTRC process allow for control of such unwanted chemical processes. Therefore, the HTRC, LTRC and CRC processes generate less waste products than the prior art hydrocarbon cracking methods.

Expected Production Rates

The expected production rate of a single industrial facility employing the CRC process based on an accelerator with an electron energy of 2-10 MeV and an electron beam power of ~100 mA is 500-700 thousands tons of petroleum feedstock per year. The production rate for the CRC process (given the conditions stated above) can be increased by an order of magnitude if the petroleum feedstock is bubbled with ionized air and/or ionized air is injected into the reactor vessel in a dispersed form. Using this technique, the irradiation dose necessary for realization of CRC can be reduced to the value of 1-2 ky.

An increase in the temperature of the petroleum feedstock up to 350° C. in the LTRC process will further increase the reaction rate of hydrocarbon molecule cracking by 20-30 fold.

EXAMPLES

Example 1

In this example, the petroleum feedstock was fuel oil (i.e., the heavy residua of primary oil distillation). The fuel oil petroleum feedstock is characterized in Table 3. The fuel oil was processed using HTRC as described with the following parameters: pulse irradiation mode (pulse width of 5 μs and pulse frequency of 200 $s^{-1}$) using electrons with energy of 2 MeV in flow conditions at the temperature of 410° C. and time-averaged dose rate of 2 kGy/s for a total absorbed electron dose of 3 kGy.

The total yield of liquid product (fraction boiling out below 450° C.) produced using the HTRC method under the conditions described above was 76% (by mass) and the yield of motor fuels (fraction with BP up to 350° C.) was 45% (by mass). However, the liquid commodity petroleum products produced were unstable and demonstrated a strong tendency toward coking. After a 10-day storage post-processing, the concentration of the fraction with BP<350° C. (motor fuels) decreased by 10% (by mass).

In this example, for the given type of petroleum feedstock utilized (fuel oil) and the HTRC processing conditions employed, the limiting dose of irradiation as defined by the stability of the commodity petroleum products is lower than 3 kGy.

To increase the limiting dose of irradiation (as defined by the stability of the commodity petroleum products) and to increase the yields of desirable commodity petroleum products (in this case motor fuels such as gasoline), the same fuel oil petroleum feedstock was preliminarily bubbled with ionized air produced as a by-product of the electron accelerator operation for 7 minutes at a temperature of 180° C. before being subject to HTRC processing. The ionized air aids in the destruction of the radiation-resistant cluster structure present in the fuel oil petroleum feedstock, reducing the tendency toward coking and increasing the stability of the produced commodity petroleum products. The reduction of radiation-resistant cluster structures allows the limiting dose of radiation, as defined by the stability of the commodity petroleum products to be increased. At the same time, the ionized air increased the desulfurization of the petroleum feedstock and causes oxidation reactions that facilitate destruction of high-molecular compounds. As a result, the temperature required for HTRC processing can be lowered.

To further increase the limiting dose of irradiation (as defined by the stability of the commodity petroleum products) and to increase the yields of desirable commodity petroleum products (in this case motor fuels such as gasoline), the fuel oil petroleum feedstock was irradiated with an increased electron dose rate. In this example, the fuel oil was processed using HTRC as described with the following parameters: pulse irradiation mode (pulse width of 5 μs and pulse frequency of 200 $s^{-1}$) using electrons with energy of 2 MeV in flow conditions at the temperature of 380° C. and time-averaged dose rate of 6 kGy/s for a total absorbed electron dose of 3.5 kGy.

Figure 4A:
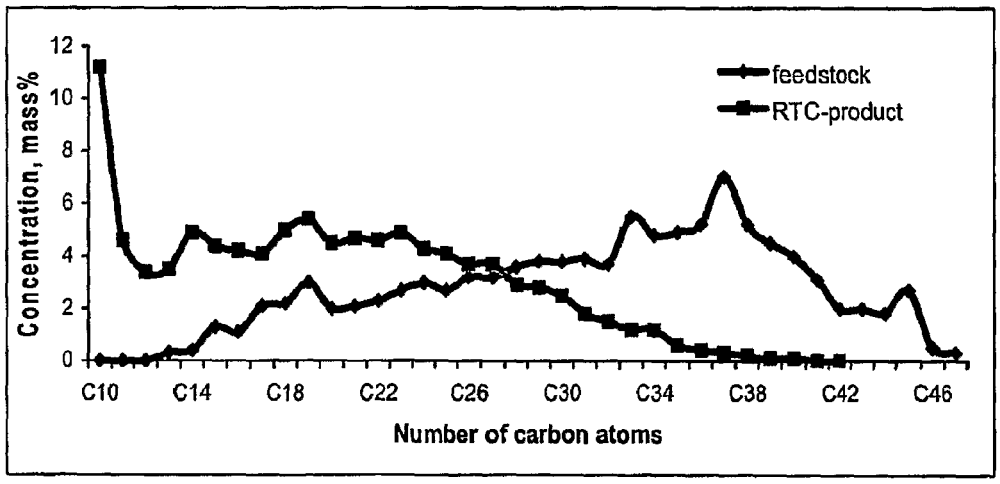
FIGS. 4A and 4B show the products, by changes in fractional content, of a high viscosity petroleum feedstock after undergoing RTC processing after preliminarily bubbling with ionized air for 7 minutes prior to RTC processing. RTC processing was carried out using pulsed irradiation (pulse width of 5 μs and pulse frequency of 200 $s^{-1}$) under flow conditions with the following parameters: total absorbed electron dose—3.5 kGy; time averaged electron dose rate—6 kGy/s; temperature of processing—380° C.
Figure 4B:
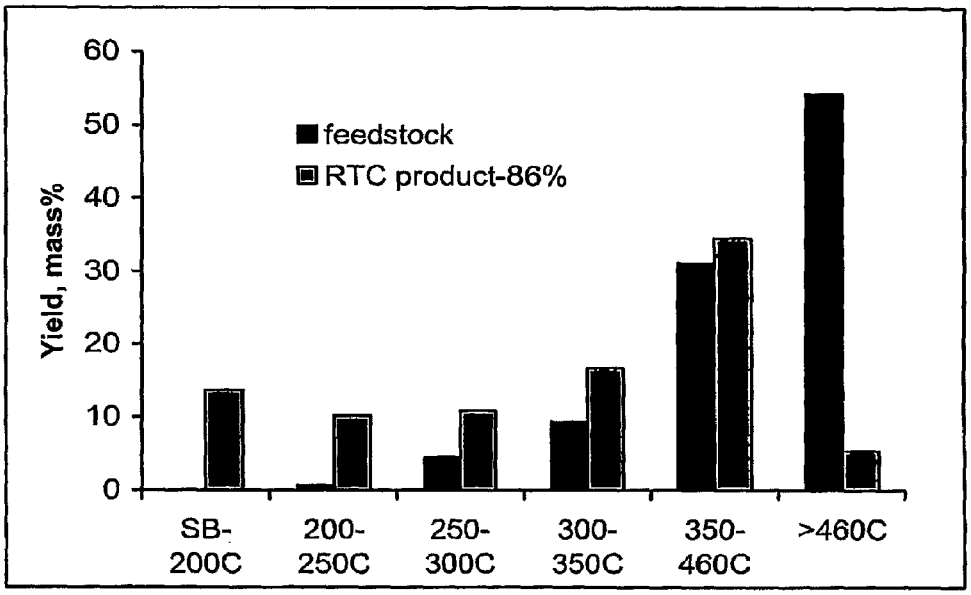

The total yield of liquid product (fraction boiling out below 450° C.) produced using the HTRC method under the conditions described above was 86% (by mass); the yield of gases was 8.6% by mass and the yield of coking residue was 5.4% (by mass). The yield of motor fuels (fraction with BP up to 350° C.) was 52% (by mass). The results are illustrated in FIGS. 4A and B.

Using HTRC processing with the conditions described above, the commodity petroleum products were stable. The fractional contents of the treated petroleum feedstock one year after HTRC processing as described did not show any changes within the error of measurements. In this example, for the given type of petroleum feedstock utilized (fuel oil) and the HTRC processing conditions employed, the limiting dose of irradiation as defined by the stability of the commodity petroleum products is greater than 3.5 kGy due to bubbling of ionized air into the petroleum feedstock prior to HTRC processing and application of the heightened dose rate of irradiation.

An additional result of the HTRC processing as described was decrease in total sulfur content in the liquid commodity petroleum product produced. The sulfur content was reduced by up to 1% (by mass), which is 3 times lower than the sulfur concentration in the liquid product of direct distillation of the fuel oil. Since no other special measures for desulfurization were undertaken, the decrease in sulfur content is the direct result of bubbling of ionized air into the petroleum feedstock prior to HTRC processing.

Example 2

In this example, a high-viscous oil and fuel oil were used as the petroleum feedstocks. The high-viscous oil and fuel oil petroleum feedstocks are characterized in Table 4. The high-viscous oil and fuel oil were processed using HTRC as described with the following parameters: pulse irradiation mode (pulse width of 5 μs and pulse frequency of 200 $s^{-1}$) using electrons with energy of 2 MeV in flow conditions at the temperature of 430° C. and time-averaged dose rate of 1 kGy/s for a total absorbed electron dose of 7 kGy. The characterization of the commodity petroleum products obtained are also characterized in Table 4.

In this example, the desired commodity petroleum product was the basic material for lubricant production characterized by longer hydrocarbon chains (carbon chain lengths of 20 and above) and higher molecular mass compared with motor fuels (see Table 1).

In contrast to the requirements for the optimal production of commodity petroleum products such as motor fuels, an important role in HTRC processing for the production of lubricants is performed by radiation-induced polymerization, which reduces the mono-olefin content in the lubricant-containing fraction and attenuates its oxidation. The heavy polymer deposit forming during HTRC processing is the result, in part, of the high adsorption capacity of such compounds. The intense olefin polymerization combined with radiation-induced adsorption causes efficient release of the lubricant-containing fraction from pitches, asphaltenes, mechanical impurities, if available, and further easy extraction of purified lubricants. The combination of high rates of destruction and olefin polymerization are provided by HTRC processing at temperatures higher than the temperature characteristic for the start of HTRC in conditions favorable for development of non-destructive thermally activated processes.

This example shows that variation of irradiation parameters, such as, but not limited to, temperature, time averaged dose rate, total dose and petroleum feedstock, subject to the basic phenomenon of HTRC processing allows control on the required length of the hydrocarbon chain and provides different types of products obtained from the same feedstock.

Example 3

In this example, a high viscosity crude oil (viscosity $\nu_{20}$=2200 cCt, density $\rho_{20}$=0.95 g/$cm^3$, considerable contents of sulfur (about 2 mass %) and vanadium (100-120 μg/g)) was used as the petroleum feedstock and was processed using LTRC as described above using the following parameters: pulse irradiation mode (pulse width of 5 μs and pulse frequency of 200 $s^{-1}$) using electrons with an energy of 2 MeV in static (meaning no petroleum feedstock flow and no bubbling of ionized air or water vapor) conditions at a temperature of 250° C. and a time averaged dose rate of 10 kGy/s for a total absorbed electron dose of 1.8 MGy.

Figure 5A:
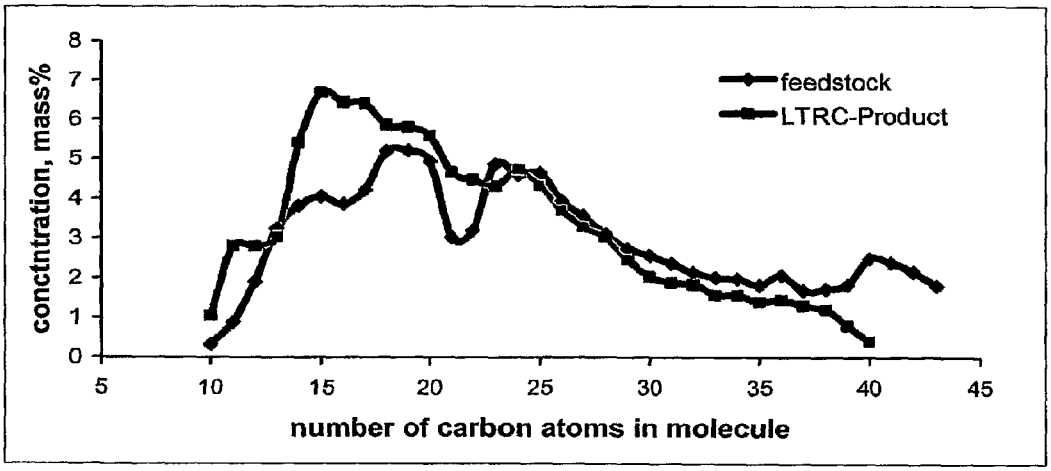
FIGS. 5A and 5B show the products, by changes in fractional content, of a high viscosity petroleum feedstock after undergoing LTRC processing using pulsed irradiation (pulse width of 5 μs and pulse frequency of 200 $s^{-1}$) under static conditions with the following parameters: total absorbed electron dose—1.8 MGy; time averaged electron dose rate—10 kGy/s; temperature of processing—250° C.
Figure 5B:
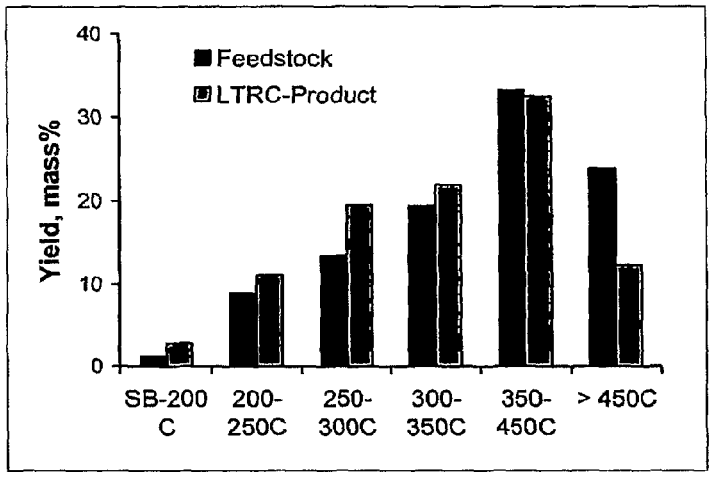

The results are illustrated in FIGS. 5A and 5B. FIG. 5A displays the results as changes in the fractional contents of the petroleum feedstock as determined by the number of carbon atoms in a molecule of the petroleum feedstock before (darker line) and after treatment (lighter line) and FIG. 5B displays the results as changes in the boiling point ranges of the petroleum feedstock before (darker bars) and after treatment (lighter bars). The treated petroleum feedstock contained 95% (by mass) liquid fraction and 5% (by mass) gases, with the gaseous fraction comprising 10.5% (by mass) hydrogen, 32.5% (by mass) methane, 18% (by mass) ethane, 10% (by mass) butane, 15% (by mass) ethylene, 8% (by mass) propylene, 6% (by mass) olefins and other gases.

As can be seen in FIGS. 5A and 5B, the yield of lighter (i.e. short chain) hydrocarbon fractions (indicated by the lower number of carbon atoms in the molecule, FIG. 5A, and lower boiling points, FIG. 5B) is increased and the yield of heavier (i.e. long chain and residue) hydrocarbon fractions is decreased. The boiling points of some commonly obtained commodity petroleum products are listed in Table 1. As a result of the LTRC processing the yields of fractions with boiling points of less than 350° C. increased from 43% (by mass) in the petroleum feedstock to 55.3% (by mass) in the treated petroleum feedstock. After LTRC, the concentration of the total sulfur in the gasoline and the kerosene fractions (start of boiling—250° C.) was less than 0.1% (by mass). The obtained distributions of sulfur-containing compounds have shown that LTRC process causes transformation of these sulfur-containing compounds due to radiation-induced oxidation reactions with ionized air. It results in "cleaning" motor fuels due to higher sulfur concentration in the heavy LTRC residue (fractions boiling out at temperatures higher than 450° C.).

The octane number of the gasoline fraction extracted from the overall product (start of boiling—180° C.) was 84. Similar measurements of the octane number in the gasoline extracted from the original petroleum feedstock resulted in the value of 67.

Example 4

In this example, another type of high-viscous crude oil was used as the petroleum feedstock (viscosity $\nu_{20}$=496 cCt, density $\rho_{20}$=0.92 g/cm$^3$, sulfur concentration—1.4% (by mass). Its fractional content is characterized by the dark curve in FIG. 6A and dark columns in FIG. 6B. The petroleum feedstock was processed using CRC as described above using the following parameters: pulse irradiation mode (pulse width of 3 μs and pulse frequency of 60 s$^{-1}$) using electrons with an energy of 7 MeV in non-static (i.e. with feedstock distillation under the electron beam and bubbling of ionized air into the petroleum feedstock during radiation processing inside the reactor vessel) at a temperature of 170° C. and a time averaged dose rate of 2.7 kGy/s for a total absorbed electron dose of 300 kGy.

Figure 6A:
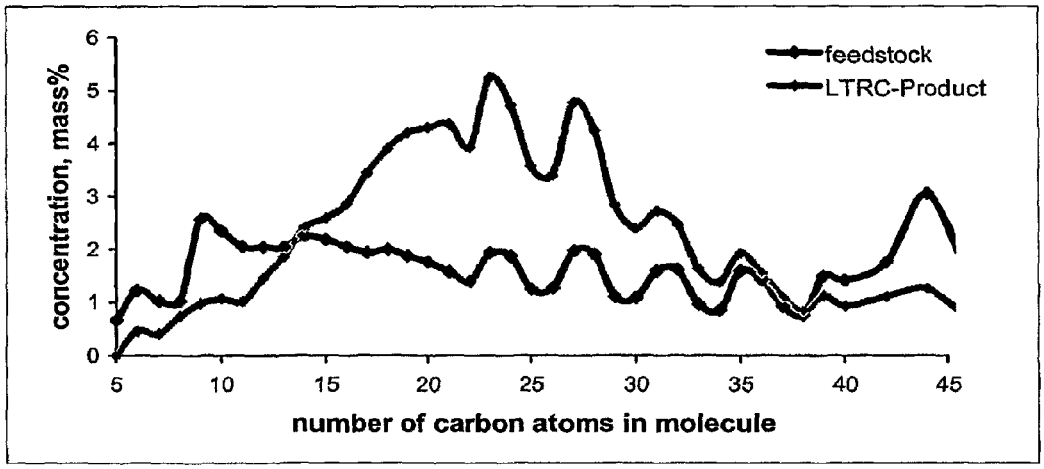
FIGS. 6A and 6B show the products, by changes in fractional content, of a high viscosity petroleum feedstock after undergoing CRC processing using pulsed irradiation pulse width of 3 μs and pulse frequency of 60 $s^{-1}$) under non-static conditions with the following parameters: total absorbed electron dose—300 kGy; time averaged electron dose rate—2.7 kGy/s; temperature of processing—170° C.
Figure 6B:
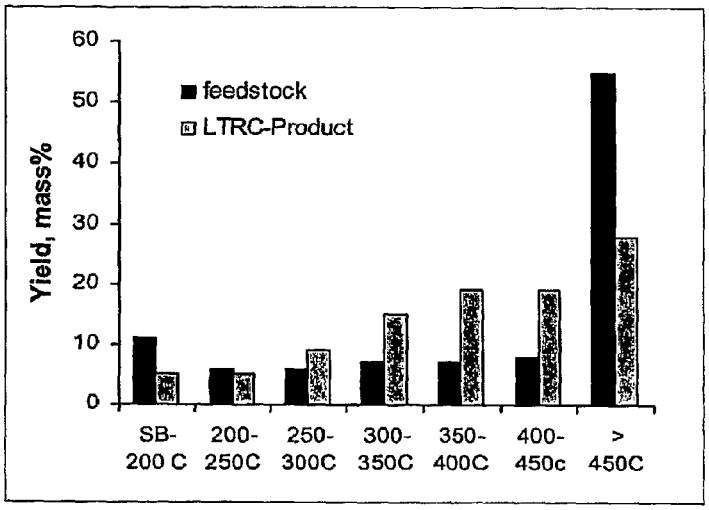

The results are illustrated in FIGS. 6A and 6B. FIG. 6A displays the results as changes in the fractional contents of the petroleum feedstock as determined by the number of carbon atoms in a molecule of the petroleum feedstock before (darker line) and after treatment (lighter line) and FIG. 6B displays the results as changes in the boiling point ranges of the petroleum feedstock before (darker bars) and after treatment (lighter bars). As with the results in FIGS. 5A and 5B, CRC processing resulted in an increased in the yield of lighter (i.e. short chain) hydrocarbon fractions (indicated by the lower number of carbon atoms in the molecule, FIG. 6A, and lower boiling points, FIG. 6B) and a decrease in the yield of heavier (i.e. long chain and residue) hydrocarbon fractions. Furthermore, the results of Example 4 show that bubbling the petroleum feedstock with ionized air allows approximately the same type of petroleum feedstock conversion (compare the results of Example 3 to Example 4) using a 6-fold lower dose (300 kGy compared with 1800 kGy in Example 2) at a considerably lower dose rate (2.7 kGy/s compared with 10 kGy/s in Example 2).

Example 5

Figure 7A:
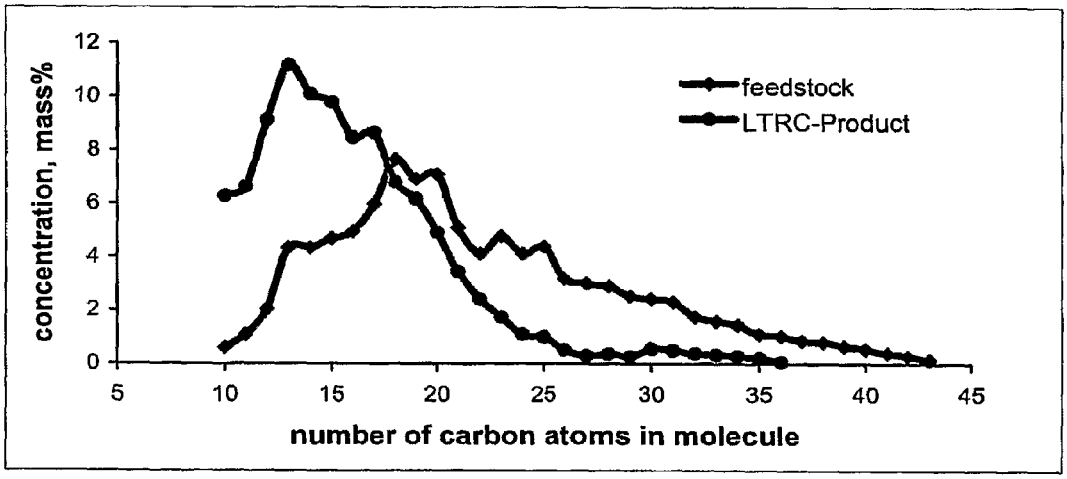
FIGS. 7A and 7B show the products, by changes in fractional content, of a high viscosity petroleum feedstock after undergoing LTRC processing using pulsed irradiation (pulse width of 5 μs and pulse frequency of 200 $s^{-1}$) under non-static conditions with the following parameters: total absorbed electron dose—26 kGy; time averaged electron dose rate—10 kGy/s; temperature of processing—220° C.
Figure 7B:
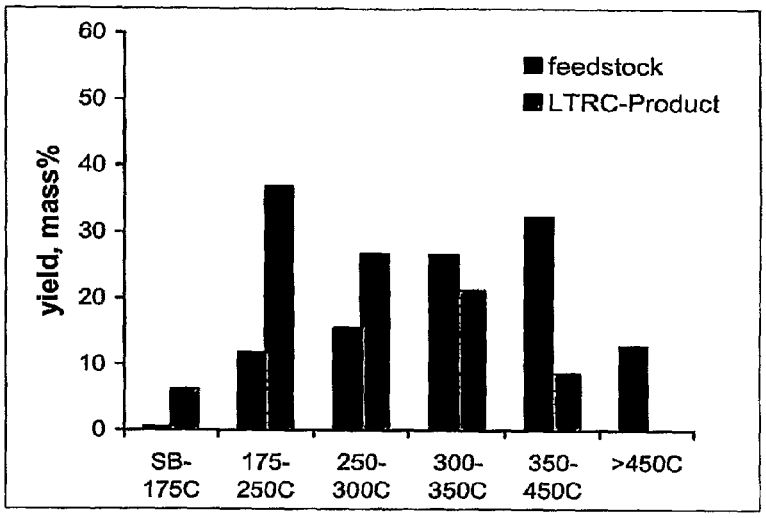

In this example, the same petroleum feedstock was used as described in Example 3. Again the petroleum feedstock was processed using LTRC as described above using the following parameters: pulse irradiation mode (pulse width of 5 μs and pulse frequency of 200 s$^{-1}$) using electrons with an energy of 2 MeV in non-static (i.e. with feedstock distillation under the electron beam and bubbling of ionized air into the petroleum feedstock during radiation processing inside the reactor vessel) at a temperature of 220° C. and a time averaged dose rate of 10 kGy/s for a total absorbed electron dose of 26 kGy. The results are illustrated in FIGS. 7A and 7B. FIG. 7A displays the results as changes in the fractional contents of the petroleum feedstock as determined by the number of carbon atoms in a molecule of the petroleum feedstock before (darker line) and after treatment (lighter line) and FIG. 7B displays the results as changes in the boiling point ranges of the petroleum feedstock before (darker bars) and after treatment (lighter bars).

As can be seen in FIGS. 7A and 7B the changes in fractional contents of the petroleum feedstock under the conditions of Example 5 were more pronounced, especially in the fractions having a boiling point of less than 300° C. In addition, LTRC processing under the conditions of Example 5 results in practically complete liquidation of the heavy residue with the boiling temperature higher than 450° C. This increase in conversion occurred even though the total absorbed electron dose was significantly decreased at the same dose rate as compared to Example 3. The experimentally observed rate of the hydrocarbon molecule cracking reaction was approximately 4.9 s$^{-1}$. This reaction rate was approximately 63% higher than the rate of the hydrocarbon molecule cracking reaction observed at a temperature of 400° C. and the dose rate of 4 kGy/s for the same petroleum feedstock.

Comparison with Example 4 shows that an increase in the dose rate (10 kGy/s compared with 2.7 kGy/s in Example 4) and temperature of processing (220° C. compared with 170° C. in Example 4) allowed approximately the same degree of petroleum feedstock conversion using a total dose 11.5 fold lower (26 kGy compared with 300 kGy in Example 4).

The dose ratio in these two example is equal to the factor $$S = \frac{D_1}{D_2} = \left(\frac{P_1}{P_2}\right)\exp\left(H\frac{T_1 - T_2}{T_1 T_2}\right),$$

where H is the activation energy for light radicals diffusion in hydrocarbons (H≈8.4 kJ/mole) and indexes 1 and 2 refer to the values of quantities in the two different experiments. Substituting the values of the dose rate and the temperatures in Examples 4 and 5, S=11.3 which corresponds to the experimental dose ratio. Thus, the data given in these examples are in agreement with the concepts disclosed in the present disclosure and show that the same processes are valid for the two types of high-viscous crude oil used as petroleum feedstock in Examples 4 and 5.

Example 6

In this example, the same petroleum feedstock was used as described in Example 3. Example 6 compares the dependence of the initial hydrocarbon molecule cracking rate, W, on the dose rate, P, of electron irradiation at 400° C. (for RTC) and 220° C. (for LTRC) The results are shown in FIG. 8.

According to commonly accepted theory of radiation-thermal cracking [2], the rate of thermally activated cracking propagation W is proportional to the factor $P^{1/2}$ exp (−E/kT). The value of activation energy for chain propagation, E, characteristic for hydrocarbons is 250 kJ/mole. Therefore, attainment of the same cracking rate at 220° C. would require increase of the dose rate by $$\exp\left(\frac{2E(T_1 - T_2)}{T_1 T_2}\right) \approx 51{,}550$$

times. Therefore, obtaining a similar hydrocarbon molecule cracking rate at a temperature of 220° C. would be for all practical purposes impossible.

Figure 8:
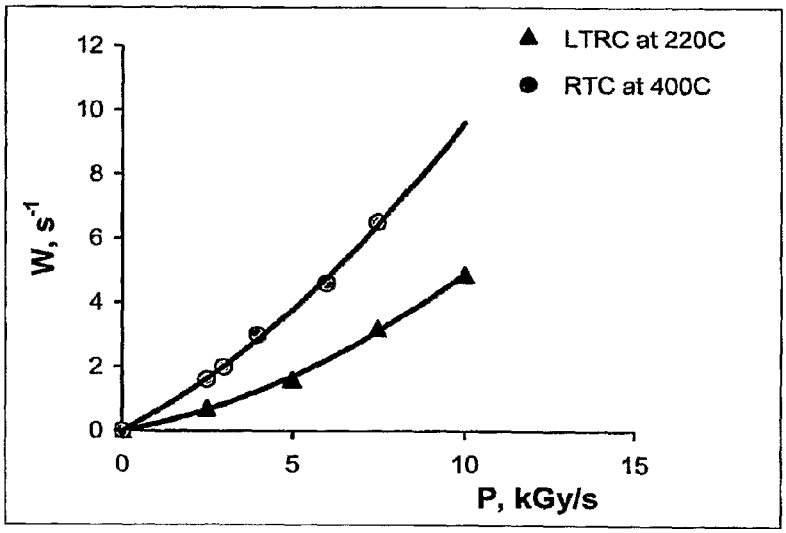
FIG. 8 shows a comparison of the dependence of the initial hydrocarbon chain cracking rate, W, on the dose rate, P, of electron irradiation at 400° C. (for RTC) and 220° C. (for LTRC).

FIG. 8 shows that this commonly accepted theory is not accurate. For example, at the temperature of 400° C. and the dose rate of electron irradiation of 4 kGy/s the observed hydrocarbon molecule cracking rate is 3 s$^{-1}$. FIG. 8 shows that the same hydrocarbon molecule cracking rate is 3 s$^{-1}$ can be obtained using the LTRC methods of the present disclosure at a temperature of 220° C. and a dose rate of 7.5 kGy/s, which is only 1.9 time greater than the dose rate required using RTC at a temperature of 400° C.

Example 7

In this example, the same petroleum feedstock was used as described in Example 3. The petroleum feedstock was processed using CRC as described using the following parameters: pulse irradiation mode pulse width of 5 μs and pulse frequency of 200 s$^{-1}$) using electrons with an energy of 2

MeV in static conditions at the temperature of 50° C., a time averaged dose rate of 36-40 kGy/s and a total absorbed dose of 320 kGy.

Figure 9A:
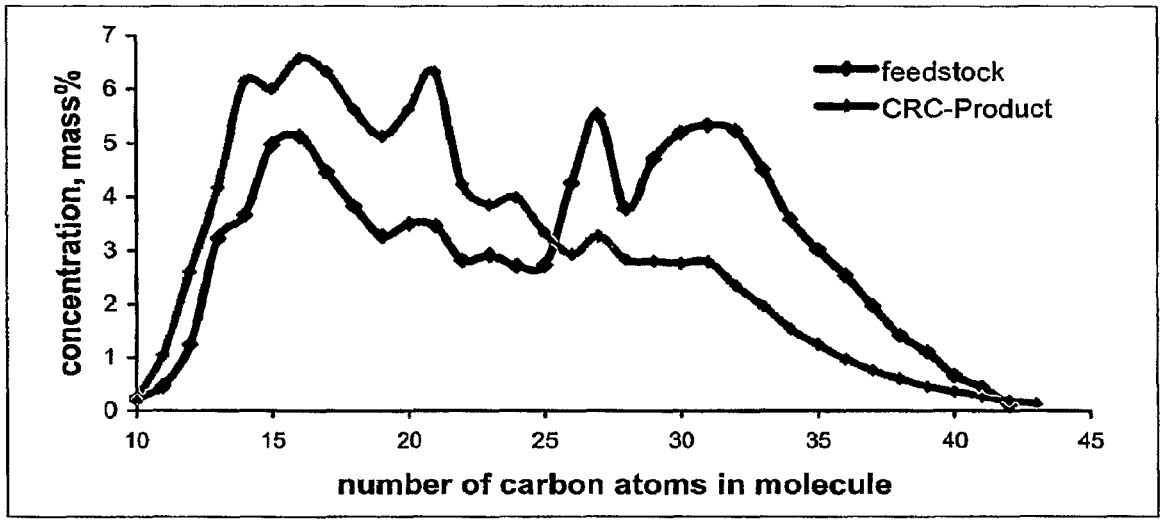
FIGS. 9A and 9B show the products, by changes in fractional content, of a high viscosity petroleum feedstock after undergoing CRC processing using pulsed irradiation (pulse width of 5 μs and pulse frequency of 200 $s^{-1}$) under static conditions with the following parameters: total absorbed electron dose—320 kGy; time averaged electron dose rate—36-40 kGy/s; temperature of processing—50° C.
Figure 9B:
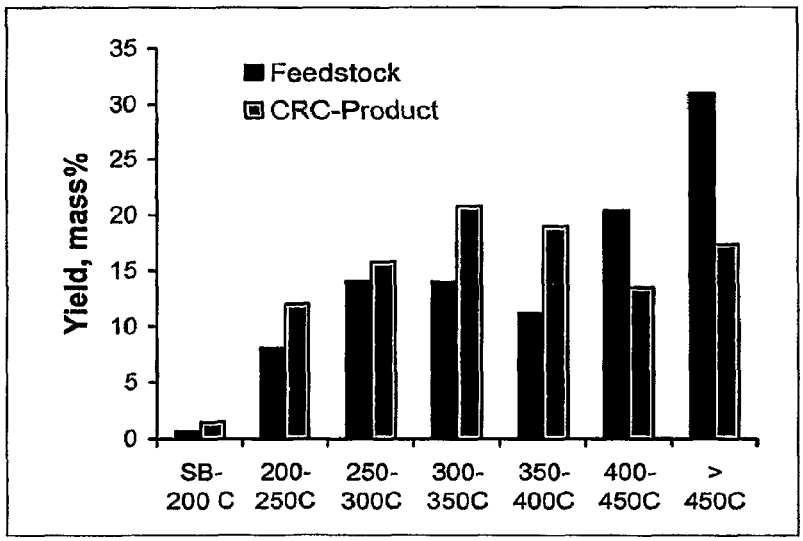

The results are illustrated in FIGS. 9A and 9B. FIG. 9A displays the results as changes in the fractional contents as determined by the number of carbon atoms in a molecule of the petroleum feedstock before (darker line) and after treatment (lighter line) and FIG. 9B displays the results as changes in the boiling point ranges of the petroleum feedstock before (darker bars) and after treatment (lighter bars). Comparison of chromatography data in FIG. 9A shows that CRC process causes considerable changes in fractional contents of the untreated versus treated petroleum feedstock. Notably, after CRC processing the concentration of heavy fractions (represented by fraction having molecules with over 27 carbon atoms and boiling points greater than about 400° C.) decreases and the average molecular mass of the component in the various fractions contents becomes considerably lower indicating products with smaller hydrocarbon chains have been formed.

The effects of CRC processing were the decrease in the heavy residue content and increase in concentration of light fractions, which include various types of commodity fuels among other components. The degree of petroleum feedstock conversion was conventionally defined by changes in concentration of the heavy residua boiling out at the temperatures higher than 450° C. In this example, the degree of the petroleum feedstock conversion reached 47% (by mass) after 9 seconds of radiation processing; the rate of conversion was 5.2% per second.

Example 8

In this example, the same petroleum feedstock was used as described in Example 3. The petroleum feedstock was processed using CRC as described using the following parameters: pulse irradiation mode (pulse width of 5 μs and pulse frequency of 200 $s^{-1}$) using electrons with an energy of 2 MeV in static conditions at the temperature of 30° C., a time averaged dose rate of 14 kGy/s and a total absorbed dose of 450 kGy.

In one of the experimental runs 1.5 mass % methanol was added into the feedstock prior to said treatment. Fractional contents of the liquid product of the feedstock processing in said conditions without methanol addition and that with methanol added to the feedstock before electron irradiation are compared in FIG. 10.

Figure 10:
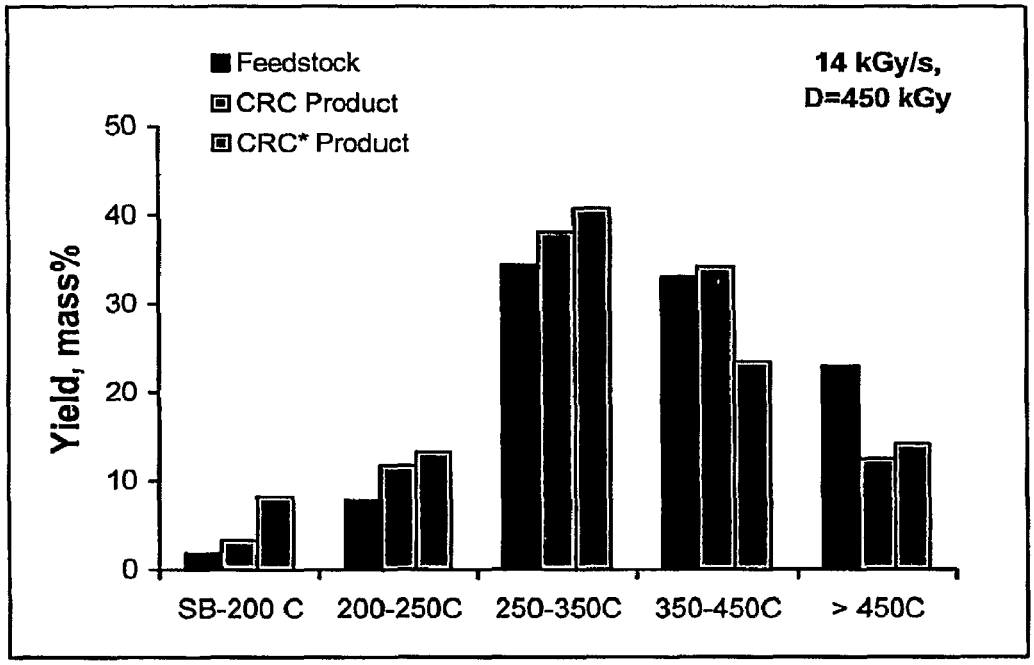
FIG. 10 shows the products, by changes in fractional content, of a high viscosity petroleum feedstock after undergoing CRC processing using pulsed irradiation (pulse width of 5 μs and pulse frequency of 200 $s^{-1}$) under static conditions with the following parameters: total absorbed electron dose—450 kGy; time averaged electron dose rate—14 kGy/s; temperature of processing-30° C. Fractional contents of the liquid product of the feedstock processing in said conditions without methanol addition (designated CRC Product) and that with 1.5% (by mass) methanol added (designated CRC* Product) to the feedstock before electron irradiation are compared.

FIG. 10 shows that the degree of feedstock conversion and the hydrocarbon contents of the liquid product can be purposefully changed by using special additives. Methanol addition results in deeper conversion of the fraction boiling in the range of 350-450° C. In the case of methanol addition, the conversion degree is some lower for the heavy residue boiling out at temperatures higher than 450° C. However, the total yields of light fractions boiling out below 350° C. increases almost twice when 1.5 mass % methanol is added.

Example 9

In this example, the petroleum feedstock is a heavy petroleum feedstock, bitumen. Bitumen, in its raw state, is a black, asphalt-like oil which has a consistency similar to molasses. Density of the bitumen samples was in the range of 0.97-1.00 $g/cm^3$; molecular mass was 400-500 g/mole; kinematic viscosity at 50° C. was in the range 170-180 cSt; sulfur concentration was 1.6-1.8% (by mass). Bitumen cannot be used directly in most conventional refining operations and requires upgrading to produce a useful product. In fact bitumen is so viscous it cannot be transported via pipeline without upgrading or dilution. The bitumen petroleum feedstock is processed using CRC with the following parameters: pulse irradiation mode (pulse width of 5 μs and pulse frequency of 200 $s^{-1}$) using electrons with an energy of 2 MeV in static conditions at room temperature of 50° C., a time averaged dose rate of 20-37 kGy/s and a total absorbed dose of radiation of 360 kGy. The total absorbed dose of radiation depends on the time of exposure of the petroleum feedstock to the radiation. Samples of petroleum feedstock were examined before CRC processing and after 18 seconds exposure to the electron beam during CRC processing (total absorbed electron dose equal to 360 kGy) and chromatograms were prepared.

Figure 11:
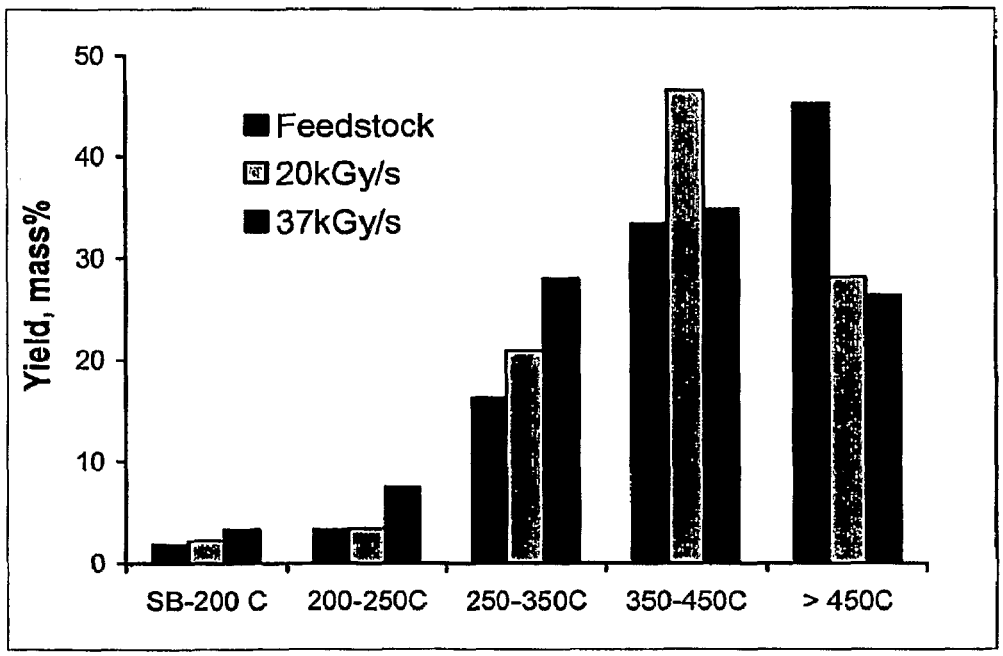
FIG. 11 shows the products, by changes in fractional content, of a bitumen feedstock after undergoing CRC processing using pulsed irradiation (pulse width of 5 μs and pulse frequency of 200 $s^{-1}$) with the following parameters: time averaged electron dose rate—20-38 kGy/s; temperature of processing-room temperature; the total absorbed dose varies with time of exposure.

The results are displayed in FIG. 11. In FIG. 11, the results are displayed as changes in the fractional contents (as determined by boiling point ranges of the petroleum feedstock before (darker bars) and after treatment (lighter bars). FIG. 11 shows that although the degree of bitumen feedstock conversion is somewhat lower than that observed after processing of the petroleum feedstocks comprising lighter hydrocarbon chains (see Examples 3-7), CRC processing significantly altered the hydrocarbon chain length in the fractional contents of the bitumen feedstock. As can be seen in FIG. 11, the exposure to the electron beam led to an increase in the amount of shorter chain hydrocarbon products as indicated by an increase in the components in the lower boiling point fractions. As demonstrated in Examples 3-7, the content of the heaviest hydrocarbon fractions was reduced after CRC processing.

Concentration of the total sulfur in the fractions that compose motor fuels (fractions boiling out at temperatures less than 350° C.) decreased more than two-fold after CRC processing compared with sulfur concentration in the products of primary thermal distillation of the original bitumen petroleum feedstock.

The degree of petroleum feedstock conversion was determined as described in Example 7. In this example, the degree of the petroleum feedstock conversion increases proportionally to the time of exposure, reaching 45% conversion (by mass) after 18 seconds of radiation processing; the rate of conversion is 2.5% per second.

The elemental balance of the overall product of bitumen radiation processing is shown in Table 5. Table 5 shows that water present in the organic part of bitumen compensates for hydrogen deficiency. The formation of light hydrocarbons in the reactions described herein requires increased hydrogen concentrations in the light fractions. In heavy petroleum feedstocks, such as, but not limited to, bitumen, the yields of the light fractions are limited by the high C/H ratios. High yields of light fractions after radiation processing of such extremely heavy petroleum feedstock is possible due to water originally present or specially added to bitumen. In this example, the petroleum feedstock contained 6% (by mass) water.

Example 10

In this example, two types of petroleum feedstock were used: the first feedstock was as described in Example 3 (Sample 1) and the second feedstock was as described in Example 4 (Sample 2). Sample 1 was processed using CRC as described above using the following parameters: continuous irradiation mode using electrons with an energy of 2 MeV in static conditions at a temperature of 50° C. and a time averaged dose rate of 80 kGy/s. Sample 2 was processed in the same conditions but using the time averaged dose rate of 120 kGy/s. The total absorbed dose of radiation depends on the time of exposure of the petroleum feedstock to the radiation. For FIG. 12A (Sample 1) the total absorbed dose of radiation was 100 kGy; for FIG. 12B (Sample 2) the total absorbed dose of radiation was 50 kGy.

Figure 12A:
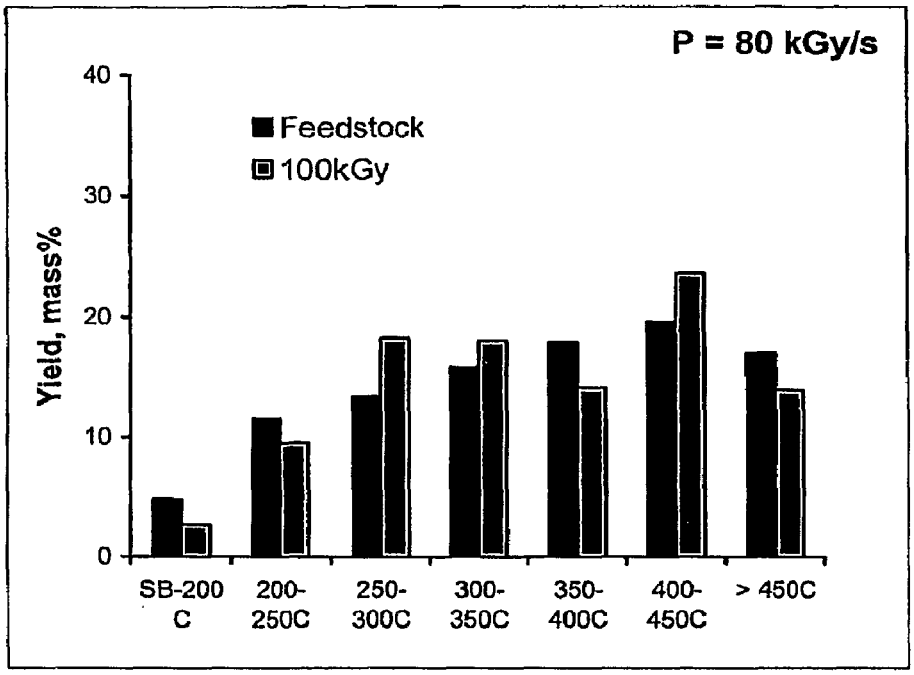
FIGS. 12A and 12B show the products, by changes in fractional content, of two high viscosity petroleum feedstocks (Sample 1, FIG. 11A and Sample 2, FIG. 11B) after undergoing CRC processing with varying dose rates. Sample 1 was processed using CRC with continuous irradiation mode under static conditions with the following parameters: total absorbed electron dose—100 kGy; electron dose rate—80 kGy/s; temperature of processing—50° C. Sample 2 was processed using CRC with continuous irradiation mode under static conditions with the following parameters: total absorbed electron dose—50 kGy; electron dose rate—120 kGy/s; temperature of processing—50° C.
Figure 12B:
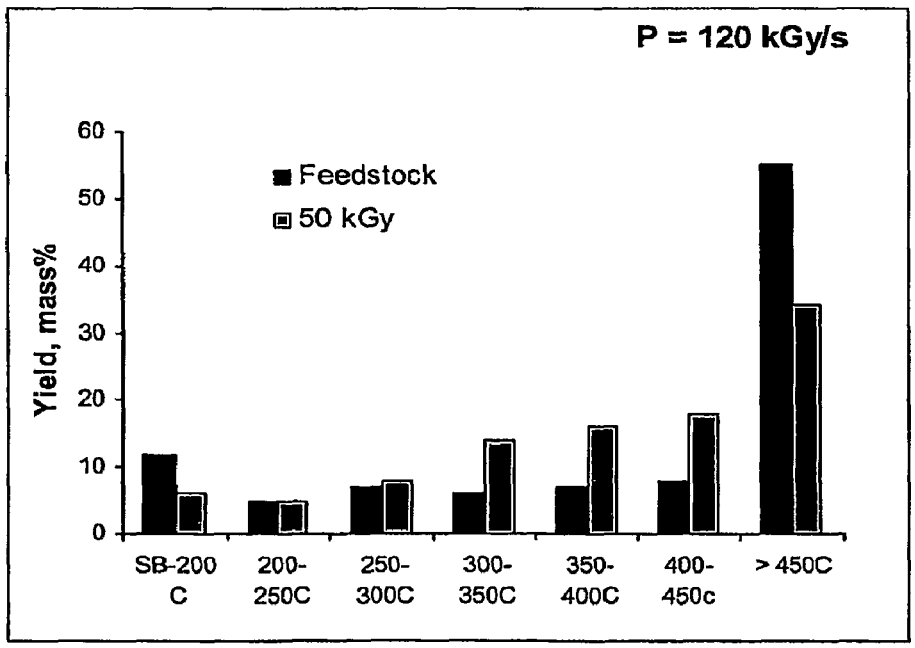

The results are displayed in FIG. 12A for Sample 1 and FIG. 11B for Sample 2. In FIGS. 12A and 12B, the results are displayed as changes in the fractional contents (as determined by boiling point ranges) of the petroleum feedstock before (darkest bars) and after treatment (lighter bars) at the time points indicated.

Comparison of FIGS. 12A and 12B shows that nearly the same degree of oil conversion (about 50% by mass) can be attained at the dose rate of 80 kGy/s and total dose of 100 kGy or at the dose rate of 120 kGy/s and total dose of 50 kGy. According to the dependence of the cracking reaction on the dose rate characteristic for the process of the present disclosure the ratio of these two doses must be $(120\ kGy/s/80\ kGy/s)^{3/2}$ that is approximately equal to 1.8. Therefore, the experimentally observed dose ratio is in accordance with the concepts provided in the present disclosure.

Figure 13:
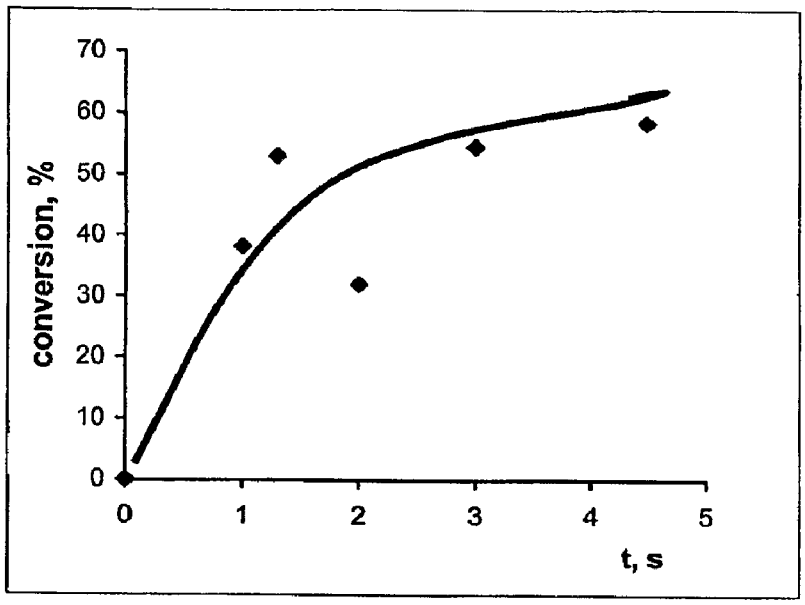
FIG. 13 shows the degree of its conversion after CRC processing of Sample 1 as described in FIG. 12A.

FIG. 13 shows degree of petroleum feedstock conversion as a function of irradiation time for Sample 1. In this example, the degree of the petroleum feedstock conversion increases proportionally to the time of exposure reaching about 50% conversion (by mass) after 3 seconds of radiation processing; the rate of conversion is about 17% per second. Similar results were obtained for Sample 2. For the both types of petroleum feedstocks these dependences are similar. It confirms that the CRC process is generally applicable to a variety of petroleum feedstocks.

Example 11

In this example, the petroleum feedstock is fuel oil ($\rho_{20}$=0.975 g/cm$^3$ (13.5 API), $\mu_{100}$=9 cSt, $S_{total}$=2.9 mass %, Pour point—28° C., Coking ability—14.2%). The petroleum feedstock was preheated to 150° C. (heating was not maintained during CRC, which was carried out at 50° C.) and irradiated in CRC mode in flow conditions (with the flow rate of 60.1 kg/hr in a layer 2 mm thick) using the following parameters: pulse irradiation (pulse width of 5 μs and pulse frequency of 200 s$^{-1}$) using electrons with energy of 2 MeV at the time averaged dose rate of 6 kGy/s. The feedstock was continuously bubbled with ionized air supplied into the reactor during radiation processing. The total absorbed dose of radiation depends on the time of exposure of the petroleum feedstock to the radiation. For FIG. 14 the total absorbed dose of radiation was 1.6 kGy.

In this example, the limiting dose of irradiation as defined by stability of the petroleum commodity products and the rate of cracking reaction were regulated by feedstock preheating and continuous supply of ionized air into the reactor.

Figure 14:
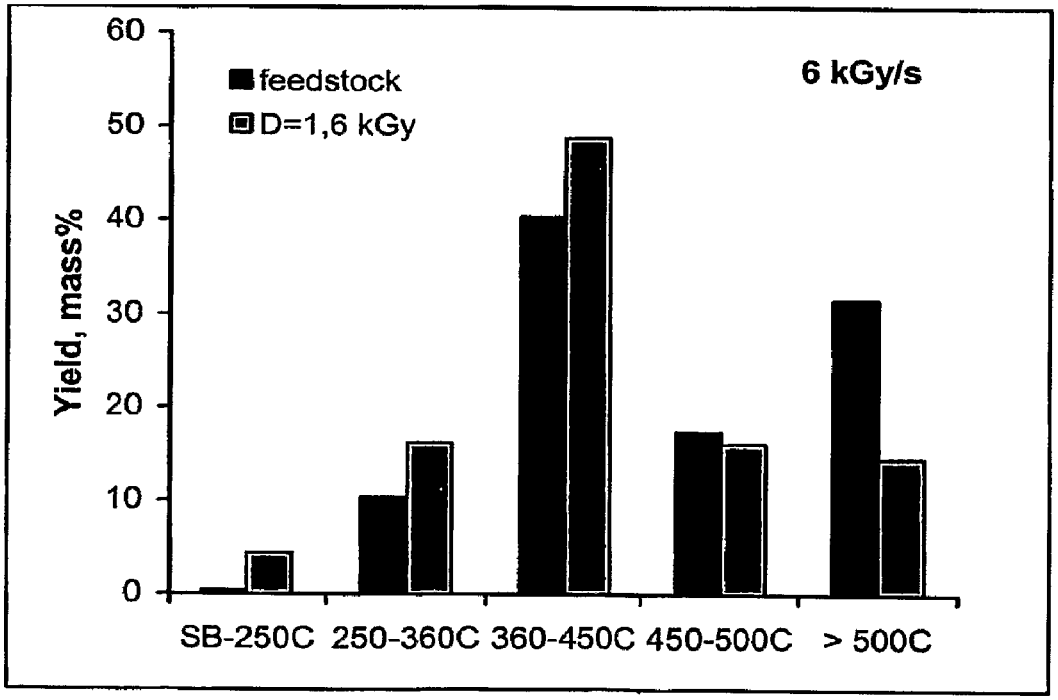
FIG. 14 shows the products, by changes in fractional content, of fuel oil after undergoing CRC processing in flow conditions (with the flow rate of 16.7 g/s in a layer 2 mm thick and continuous bubbling with ionized air) using pulsed irradiation mode (pulse width of 5 μs and pulse frequency of 200 $s^{-1}$) with the following parameters: time averaged electron dose rate—6 kGy/s; temperature of feedstock preheating—150° C.; the total absorbed electron dose—1.6 kGy.

As a result of the CRC processing as described in this example, the degree of the feedstock conversion, defined as described in Example 7, reached 53% after irradiation with the dose of 1.6 kGy (FIG. 14). The same result could be obtained in static conditions (see Example 9) at a total absorbed dose about 60 times higher and the dose rate about 15-20 times higher compared with irradiation parameters used on this example.

Example 12

In this example, the petroleum feedstock was high-viscous oil, as described in Example 3. The feedstock was preheated to 110° C. and irradiated in CRC mode in flow conditions (with the average linear flow rate of 20 cm/s in a layer 2 mm thick) using the following parameters: pulse irradiation (pulse width of 5 μs and pulse frequency of 200 s$^{-1}$) using electrons with energy of 2 MeV at the time averaged dose rate of 6 kGy/s. Feedstock preheating was necessary for lower oil viscosity and the higher rate of its passage under the electron beam in a thin layer. The total absorbed dose of radiation depends on the time of exposure of the petroleum feedstock to the radiation. For FIG. 15 the total absorbed dose of radiation was 10-60 kGy.

The petroleum feedstock was not heated during irradiation. The temperature of the liquid product accumulated in the receiving tank after processing was 30-40° C. The products were analyzed in 3-10 hours after processing.

Figure 15:
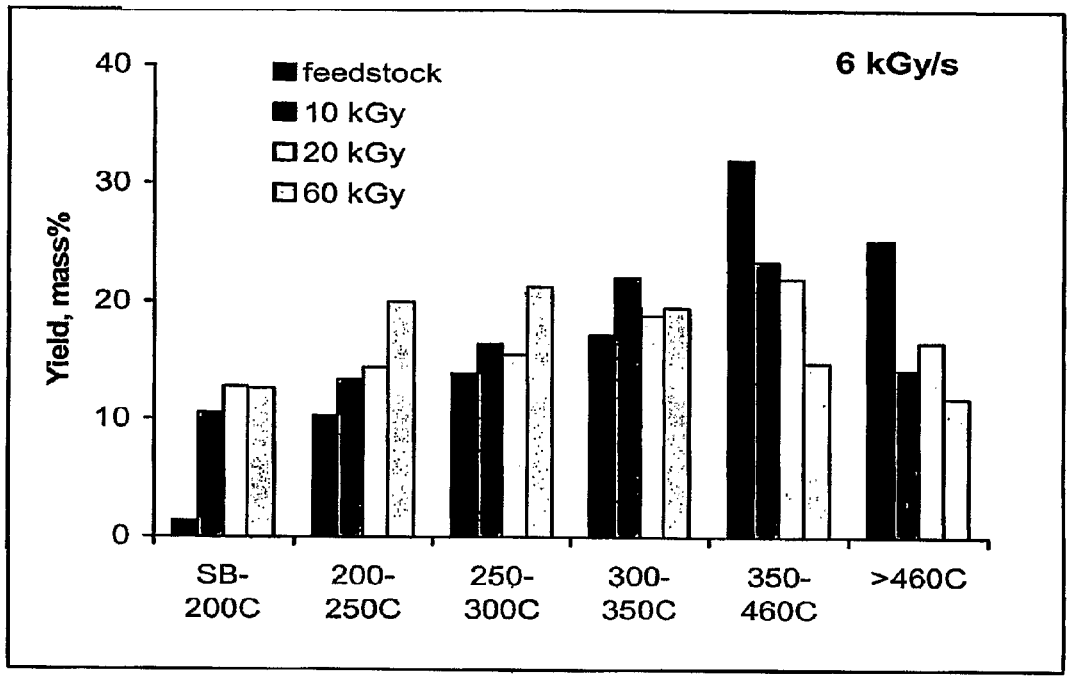
FIG. 15 shows the products, by changes in fractional content, of fuel oil after undergoing CRC processing in flow conditions (with the average liner flow rate of 20 cm/s in a layer 2 mm thick) using pulsed irradiation mode (pulse width of 5 μs and pulse frequency of 200 $s^{-1}$) with the following parameters: time averaged electron dose rate—6 kGy/s; temperature of feedstock preheating—100° C.; the total absorbed electron dose varies in the range of 10-60 kGy.

FIG. 15 shows that the degree of oil conversion as defined in Example 7, was about 48% at the dose of 10 kGy and slowly changed with the dose reaching 52% at the dose value of 60 kGy.

Figure 16:
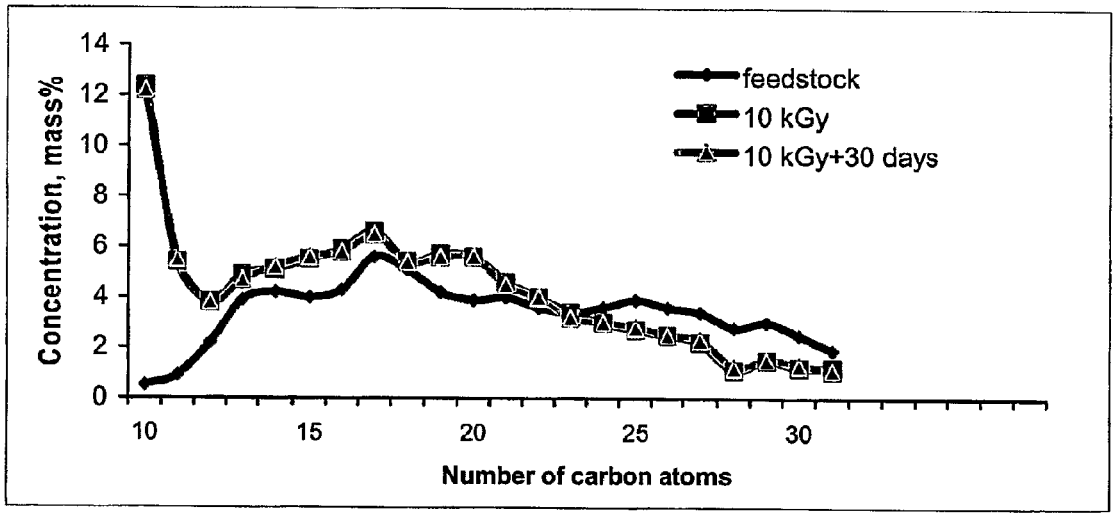
FIG. 16 shows the products, by changes in fractional content, of fuel oil after undergoing CRC processing in flow conditions (with the average liner flow rate of 20 cm/s in a layer 2 mm thick) using pulsed irradiation mode (pulse width of 5 μs and pulse frequency of 200 $s^{-1}$) with the following parameters: time averaged electron dose rate—6 kGy/s; temperature of feedstock preheating—100° C.; the total absorbed electron dose—10 kGy.

However, the commodity petroleum products obtained by irradiation with total absorbed doses higher than 10 kGy were unstable; their hydrocarbon contents changed in a time-dependent manner with higher total absorbed doses of irradiation. The liquid CRC commodity petroleum products obtained by irradiation with the total absorbed dose of 10 kGy at 6kGy/s demonstrated high stability (FIG. 16). FIG. 16 shows that its hydrocarbon content has not changed after 30 days of exposure.

Figure 17:
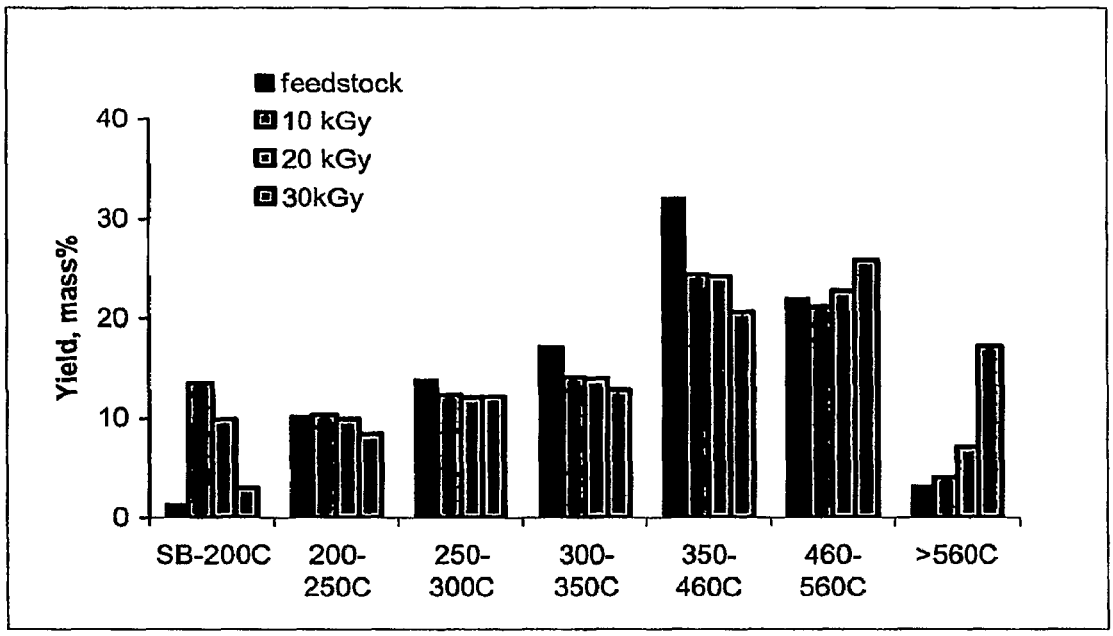
FIG. 17 shows the products, by changes in fractional content, of fuel oil after undergoing CRC processing in flow conditions (with the average liner flow rate of 20 cm/s in a layer 2 mm thick) using pulsed irradiation mode (pulse width of 5 μs and pulse frequency of 200 $s^{-1}$) with the following parameters: time averaged electron dose rate—6 kGy/s; temperature of feedstock preheating—100° C.; the fractionated absorbed doses—10, 20 and 30 kGy.

In this example, the total absorbed dose of 10 kGy is the limiting dose of irradiation and limits the product stability. FIG. 17 shows that it also limits the yields of stable commodity petroleum products. Each of the higher total absorbed dose indicated in FIG. 17 was obtained by dose fractionation. A part of the liquid product was taken for analysis after each of the subsequent irradiations. The liquid commodity petroleum products obtained by irradiation with a total dose of 10 kGy is characteristic for the highest concentration in the overall commodity petroleum product and the highest stability. To make yields of light fractions still higher other irradiation conditions (the dose rate, external treatment for changes in the feedstock original structure or the form of feedstock supply to the reactor) may also be varied.

Example 13

In this example, the petroleum feedstock was high-paraffin crude oil (Density $\rho_{20}$=0.864 g/cm$^3$ (32 API), $\mu_{50}$=18.8 mm$^2$/s, $S_{tot}$=<1.0 mass %, Pour point—29° C., Asphaltenes and resins—18%, Paraffins—20% and Coking ability—3.5%). High-paraffin crude oils are characterized by high solidification temperature. Radiation processing of this type of oil is directed to enabling the long-distance transportation of this petroleum feedstock through pipelines in different climatic conditions without application of complicated and expensive system for oil heating over all the distance of transportation. Together with high content of heavy paraffins, the high-paraffin crude oil petroleum feedstock considered in this example is characterized by high concentrations of pitches and asphaltenes.

The petroleum feedstock was preheated to 35° C. and irradiated in CRC mode in flow conditions (with the flow rate of 30 kg/hour in a layer 2 mm thick) using the following parameters: pulse irradiation (pulse width of 5 μs and pulse frequency of 200 s$^{-1}$) using electrons with energy of 2 MeV at the time averaged dose rate of 5.2 kGy/s. The total absorbed dose of radiation depends on the time of exposure of the petroleum feedstock to the radiation.

Figure 18:
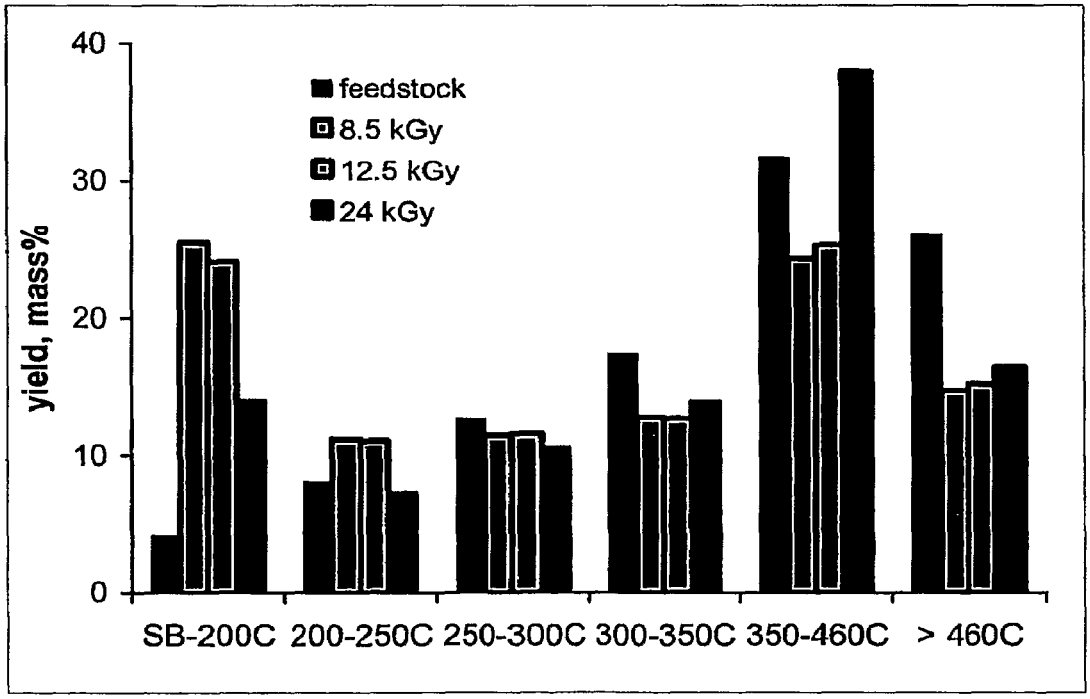
FIG. 18 shows the products, by changes in fractional content, of high paraffin crude oil after undergoing CRC processing in flow conditions (with the flow rate of 30 kg/hour in a layer 2 mm thick) using pulsed irradiation mode (pulse width of 5 μs and pulse frequency of 200 $s^{-1}$) with the following parameters: time averaged electron dose rate—5.2 kGy/s; temperature of feedstock preheating—35° C.; the time-averaged absorbed doses—8.2, 12.5 and 24 kGy.

FIG. 18 illustrates fractional contents of the products of high-paraffin oil CRC processing obtained in flow conditions for different irradiation doses. It shows that the highest conversion degree and the highest yields of light fractions are observed after CRC processing with a total absorbed dose of 8.5 kGy. Increase in the total absorbed dose over 10 kGy not only reduces the yields of light fractions but also degrades stability of the liquid petroleum commodity products due to accumulation of the reactive polymerizing residue. Similar to Example 10 for the high viscous oil, the limiting dose or irradiation as defined by product yields and stability is about 10 kGy for the given CRC processing conditions.

Heating of high-paraffinic oil to high temperatures characteristic for RTC provokes thermal activation of intense polymerization that reduces yields of light fractions and makes them instable. Therefore, CRC processing at heightened dose rates is most effective and profitable for high-paraffin oil upgrading or deep processing in industrial scales.

Example 14

In this example, the feedstock was high-paraffin fuel oil, which is a product of high-paraffin crude oil primary distillation (Density $\rho_{20}$, 0.925 g/cm$^3$ (21 API), Sulfur content<1 mass %, Pour point+45° C., Coking ability 6.8% and Kinematic viscosity at 80° C. 16.8 cSt). This type of petroleum feedstock is especially difficult for traditional methods of oil processing; due to the presence of high-molecular paraffins, which results in a very high pour point (+45° C.).

Figure 19:
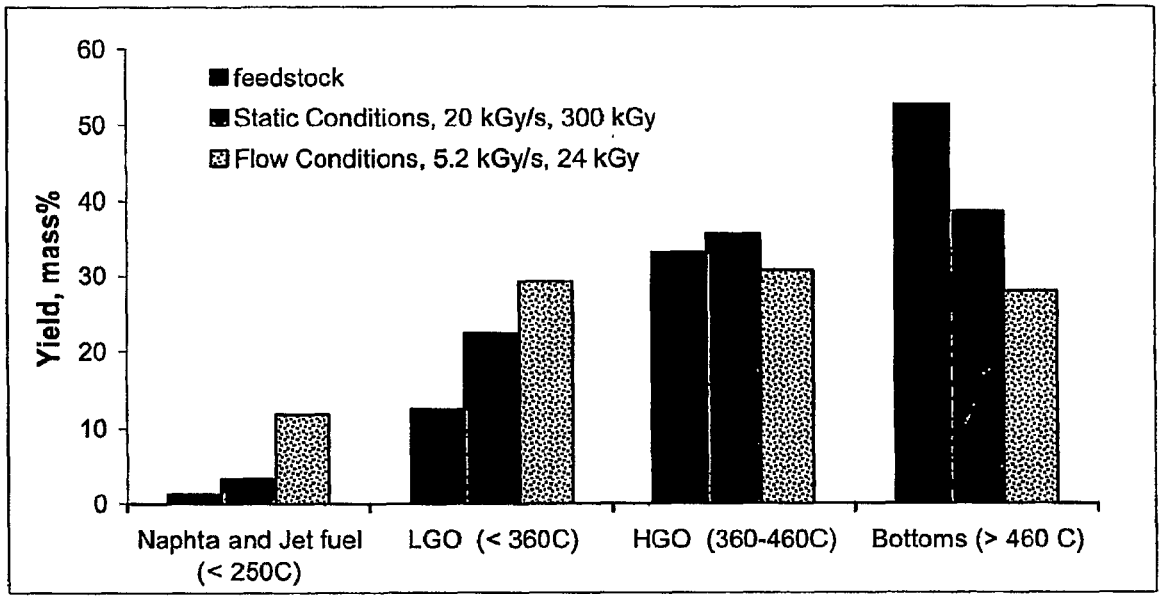
FIG. 19 shows the products, by changes in fractional content, of high-paraffin fuel oil after undergoing CRC processing in static and flow conditions (with the flow rate of 30 kg/hour in a layer 2 mm thick) using pulsed irradiation mode (pulse width of 5 μs and pulse frequency of 200 $s^{-1}$) with the following parameters: time-averaged electron dose rate—20 kGy/s in static conditions and 5.2 kGy/s in flow conditions; temperature of feedstock preheating—60° C.; the time-averaged absorbed dose—300 kGy in static conditions and 24 kGy in flow conditions.

The feedstock was preheated to 60° C. and irradiated in CRC mode in flow conditions (with the flow rate of 30 kg/hour in a layer 2 mm thick) using the following parameters: pulse irradiation (pulse width of 5 μs and pulse frequency of 200 s$^{-1}$) using electrons with energy of 2 MeV at the time averaged dose rate of 5.2 kGy/s. The irradiation dose was 24 kGy. In addition, CRC processing was also accomplished using the above parameters in static mode at the time averaged dose rate of 20 kGy/s. The irradiation dose was 300 kGy Comparison of the efficiencies of CRC processing in flow and static conditions is given in FIG. 19. The comparison shows that flow conditions provide a considerably higher effect compared with static conditions even at much lower total doses and dose rates of electron irradiation. In flow conditions, an increase in the dose rate up to 20 kGy/s will cause almost 6 times higher degree of the petroleum feedstock conversion.

Example 15

In this example, the same petroleum feedstock was used as described in Example 3 and the parameters used were as set forth in Example 10 for Sample 1 with the difference that instead of static conditions, the petroleum feedstock was atomized inside the reactor vessel and was irradiated in a dispersed form up to the dose of 3.2 kGy.

Figure 20A:
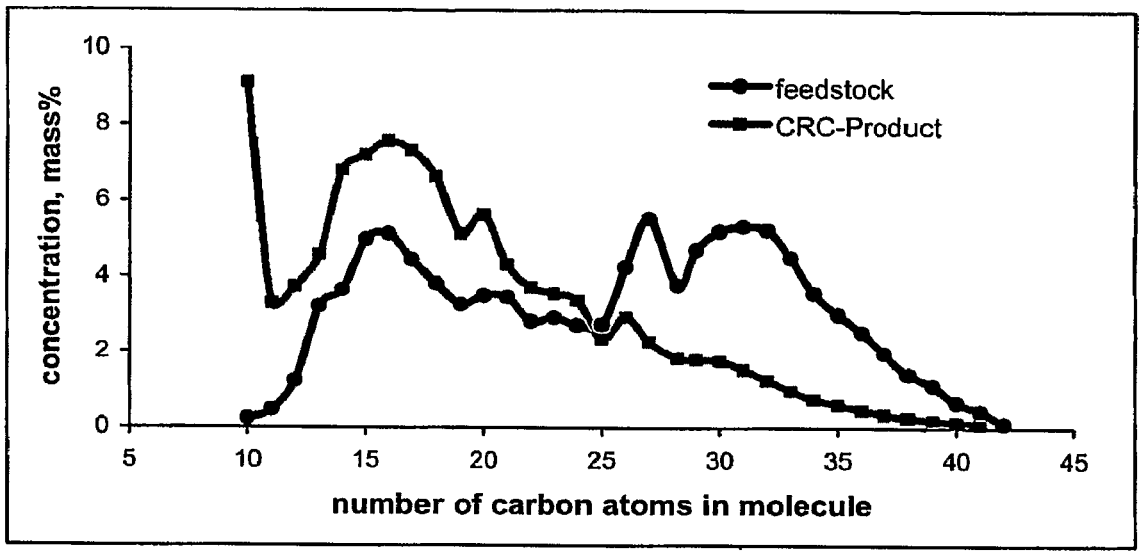
FIGS. 20A and 20B show the products, by changes in fractional content, of a high viscosity petroleum feedstock after undergoing CRC processing using continuous irradiation mode (under non-static conditions) with the following parameters: total absorbed electron dose—3.2 kGy; electron dose rate—80 kGy/s; temperature of processing—500 C.
Figure 20B:
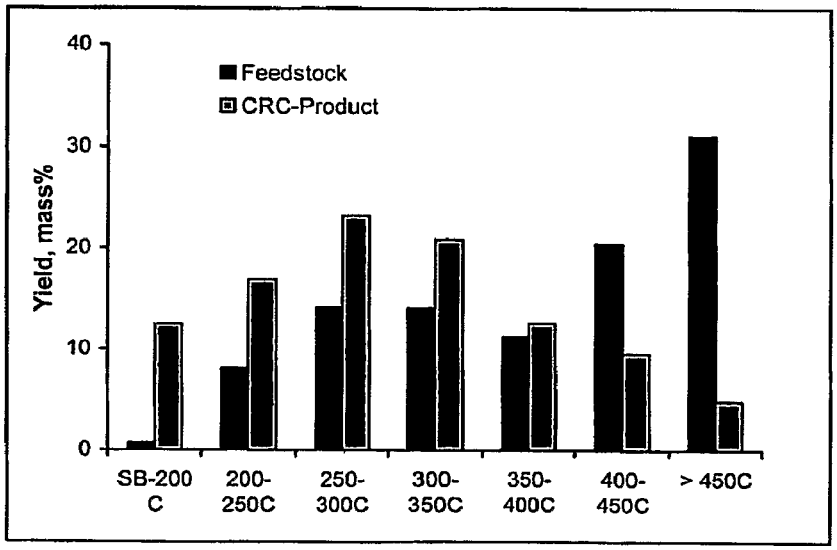

The results are displayed in FIGS. 20A and 20B. FIG. 20A displays the results as changes in the fractional contents as determined by the number of carbon atoms in a molecule of the petroleum feedstock before (darker line) and after treatment (lighter line) and FIG. 20B displays the results as changes in the boiling point ranges of the petroleum feedstock before (darker bars) and after treatment (lighter bars). As can be seen in FIGS. 20A and 20B, the yield of lighter (i.e. short chain) hydrocarbon fractions (indicated by the lower number of carbon atoms in the molecule, FIG. 20A, and lower boiling points, FIG. 20B) is increased and the yield of heavier (i.e. long chain and residue) hydrocarbon fractions is decreased. In this Example, the rate of conversion increased more than 50-fold as compared to the rate observed in Example 10. Furthermore, a degree of conversion of 80% is attained in this example at a dose of 3.2 kGy that corresponds to commercial requirements to the highly economic radiation processing. The rate of conversion is 1.25 mass % per millisecond.

TABLE 1

| Fraction | Boiling Range (° C.) | Number of Carbon Atoms |
|---|---|---|
| natural gas | <20 | C1 to C4 |
| petroleum ether | 20-60 | C5 to C6 |
| gasoline | 40-200 | C5 to C12, but mostly C6 to C8 |
| kerosene | 150-260 | mostly C12 to C13 |
| diesel fuels | >260 | C14 and higher |
| lubricants and fuel oil | >400 | C20 and above |
| asphalt or coke | residue | polycyclic |

TABLE 2

Comparison of different types of initiated cracking
TYPE OF CRACKING REACTION

| | Characteristics of the process | | | | |
|---|---|---|---|---|---|
| | Thermal cracking (TC) | Radiation-thermal cracking (RTC) | High- temperature radiation cracking (HTRC) | Low - temperature radiation cracking (LTRC) | Cold Radiation cracking (CRC) |
| Type of chain initiation and continuation | Both the initiation and propagation stages of the process are thermally activated. | The initiation stage is radiation-initiated (chain carriers are created by irradiation); the propagation stage is thermally activated (hydrocarbon molecules are thermally excited). | The same as RTC but the higher reaction rate is provided by the increased dose rate and by application of additional processing for structural modification of the feedstock | Both the initiation and propagation stages of the process are radiation-activated, but the propagation of hydrocarbon molecule cracking is enhanced by thermally activated diffusion of chain carriers | Both the initiation and propagation stages of the process are radiation-activated and are caused only by the action of radiation. |
| Characteristic energy consumption | 1900 kJ/kg | 1400 kJ/kg | 1400 kJ/kg | 450-500 kJ/kg | 100 kJ/kg |
| Characteristic operational costs | $8.00 per 1 ton of petroleum feedstock | $5.50 per 1 ton of petroleum feedstock | $5.00 per 1 ton of petroleum feedstock | $2.00-2.50 per 1 ton of petroleum feedstock | $0.50 per 1 ton of petroleum feedstock |

TABLE 2-continued

| Comparison of different types of initiated cracking TYPE OF CRACKING REACTION | | | | | |
|---|---|---|---|---|---|
| | Characteristics of the process | | | | |
| | Thermal cracking (TC) | Radiation-thermal cracking (RTC) | High- temperature radiation cracking (HTRC) | Low - temperature radiation cracking (LTRC) | Cold Radiation cracking (CRC) |
| Expected annual production rate of a single radiation facility using electron accelerator of 100 kW beam power | Not applicable | 0.6-0.8 millions tons | 0.8-1.1 millions tons | 0.6-1.0 millions tons | 0.6-0.8 millions tons |

TABLE 3

| | Feedstock | RTC product |
|---|---|---|
| Density $\rho_{20}$, g/cm$^3$ | 1.003 | 0.87 |
| Gravity, °API | 7 | 31.5 |
| Sulfur, wt % | >5.0 | 1.0 |
| Pour point, ° C. | 27 | — |
| Cocking ability, % | 12.4 | — |
| Kinematic viscosity at 80° C., mm$^2$/s, | 71.1 | 2.6 |

TABLE 4

Table. Characteristics of basic lubricant produced by radiation processing of fuel oil

| | | | Basic lubricant (Tboil >360° C.) | |
|---|---|---|---|---|
| | Feedstock | | RTC product | RTC product |
| Characteristics | Crude oil | Fuel oil | of crude oil processing | of fuel oil processing |
| Yield, mass % | | | 35 | 30 |
| Density at 20° C., g/cm$^3$ | 0.943 | 0.918 | 0.892 | 0.869 |
| Viscosity, cst at 50° C. | 117.0 | 92.0 | 48.0 | 17.7 |
| Index of viscosity | | | 94 | 100 |
| Pour Point, ° C. | −17 | 34 | <3 | −15 |
| Flash Point, ° C. | 108 | 180 | 200 | 208 |
| Sulfur, mass % | 2.5 | 1.0 | 1.1 | 0.5 |
| Acid number | | | 0.14 | 0.02 |

$T_{boil}$—boiling temperature

REFERENCES

1. RU 2078116 C1; Method for cracking of crude oil and oil products and apparatus for its realization; Kladov A. A.
2. Topchiev A. V., Polak L. S. Radiolysis of Hydrocarbons. Moscow, Publ. Acad. Sci. USSR, 1962, 205 pp.; Topchiev A. V. Radiolysis of Hydrocarbons. El. Publ. Co., Amsterdam-London-New-York, p. 232.
3. RU 2087519 C1; Method for processing of condensed hydrocarbons; Gafiatullin R. R., Makarov I. E., Ponomarev A. V., Pokhipo S. B., Rygalov V. A., Syrtlanov A. Sh., Khusainov B. Kh.
4. KZ B 13036; Method for processing of oil and oil products; Tsoi A. N., Tsoi L. A., Shatnro A. V., Sharunov I. P.
5. KZ B 11 4676; Method for oil and oil residua refining; Nadirov N. K., Zaikin Yu. A., Zaikina R. F., Al-Farabi Kazakh National University
6. Zaykin Yu. A., Zaykina R. F., Mirkin G. On energetics of hydrocarbon chemical reactions by ionizing radiation. Radiat. Phys Chem., 2003, v. 67/3-4, pp. 305-309.

What is claimed is:

1. A method of treating a petroleum feedstock by initiating a high-rate, self-sustaining chain cracking reaction in the petroleum feedstock to generate a treated petroleum feedstock, said method comprising subjecting the petroleum feedstock to ionizing irradiation, wherein the petroleum feedstock is subjected to a time-averaged irradiation dose rate of at least about 5.0 kGy/s and a total absorbed irradiation dose of at least about 0.1 kGy, and wherein the temperature of the petroleum feedstock during irradiation treatment is less than about 200° C, said irradiation treatment resulting in an increase in the radiation-chemical yield of light fractions boiling out below 450° C. and a decrease in heavy residue boiling out above 450° C.

2. The method of claim 1, wherein the petroleum feedstock is flowing during irradiation.

3. The method of claim 2, where the time-averaged irradiation dose rate is about 10 kGy/s or greater, the total absorbed irradiation dose is from about 1.0 to about 5.0kGy.

4. The method of claim 2, where the time-averaged irradiation dose rate is about 15 kGy/s or greater, the total absorbed irradiation dose is from about 1.0 to about 10.0kGy.

5. The method of claim 2, wherein the depth of the flowing petroleum feedstock during irradiation is between about 0.5 mm and 10 cm.

6. The method of claim 1, wherein the time-averaged irradiation dose rate is at least about 15 kGy/s.

7. The method of claim 1, wherein the temperature of the petroleum feedstock during irradiation is less than about 100° C.

8. The method of claim 1, wherein said ionizing irradiation is provided by electrons.

9. The method of claim 8, wherein said electrons have an energy of from about 1 to about 10 MeV.

10. The method of claim 9, wherein the irradiation treatment provides a radiation-chemical yield of light fractions of at least about 10 molecules/100 eV.

11. The method of claim 9, wherein the irradiation treatment provides a radiation-chemical yield of light fractions of at least about 100 molecules/100 eV.

12. The method of claim 1, wherein the pressure during irradiation treatment is in the range of atmospheric pressure to about 3 atmospheres.

13. The method of claim 1, further comprising thermal, mechanical, acoustic, or electromagnetic treatment of the petroleum feedstock prior to irradiation treatment, during irradiation treatment, or both prior to and during irradiation treatment.

14. The method of claim 1, further comprising treatment of the petroleum feedstock with an agent prior to or during irradiation treatment, the agent being selected from the group consisting of ionized air, water, steam, ozone, oxygen, hydrogen, methanol, and methane.

15. The method of claim 1, further comprising bubbling water vapor or ionized air through the petroleum feedstock prior to or during irradiation treatment.

16. The method of claim 1, wherein said subjecting step comprises injecting the petroleum feedstock into a reaction vessel in a dispersed form.

17. The method of claim 1, wherein the petroleum feedstock is selected from the group consisting of crude oil, high-viscous heavy crude oil, high-paraffin crude oil, fuel oil, tar, heavy residua of oil processing, wastes of oil extraction, bitumen, and used oil products.

18. The method of claim 1, wherein the total absorbed dose is less than a limiting dose of irradiation as defined by the stability of the treated petroleum feedstock, the limiting dose of irradiation and a reaction rate of the treated petroleum feedstock being regulated by a variation in the time-averaged dose rate, a flow condition parameter, an optional structural or chemical modification of the petroleum feedstock, or a combination of the foregoing.

19. The method of claim 18, wherein the stability of the treated petroleum feedstock is determined by reference to post-treatment changes in the concentration of light fractions within the treated petroleum feedstock.

* * * * *